US007845124B1

(12) United States Patent
Neal

(10) Patent No.: US 7,845,124 B1
(45) Date of Patent: Dec. 7, 2010

(54) WINDOW FRAME

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 1089 days.

(21) Appl. No.: 11/118,235

(22) Filed: Apr. 29, 2005

(51) Int. Cl.
*E06B 1/04* (2006.01)

(52) U.S. Cl. ..... 52/204.1; 52/204.5; 52/208; 52/212

(58) Field of Classification Search ..... 52/204.5, 52/204.1, 208, 212, 213, 235, 656.5, 656.6; 49/501, 504
See application file for complete search history.

(56) References Cited

U.S. PATENT DOCUMENTS

| | | | | | |
|---|---|---|---|---|---|
| 3,579,939 | A * | 5/1971 | Eichman | 52/204.591 |
| 3,722,161 | A * | 3/1973 | Brown | 52/204.597 |
| 3,766,698 | A * | 10/1973 | Dallen | 52/204.597 |
| 3,858,375 | A * | 1/1975 | Silvernail | 52/235 |
| 3,866,374 | A * | 2/1975 | Dallen | 52/204.597 |
| 3,978,629 | A * | 9/1976 | Echols, Sr. | 52/235 |
| 4,040,219 | A * | 8/1977 | Budich | 52/209 |
| 4,084,361 | A * | 4/1978 | Aspaas | 52/204.593 |
| 4,207,717 | A * | 6/1980 | Hubbard | 52/235 |
| 4,270,332 | A * | 6/1981 | Montrouil | 52/772 |
| 4,312,905 | A * | 1/1982 | Kreusel | 428/122 |
| 4,537,000 | A * | 8/1985 | Gartner | 52/235 |
| D376,209 | S * | 12/1996 | DiGiorgio | D25/122 |
| 6,067,760 | A | 5/2000 | Nowell | |
| 6,170,207 | B1 * | 1/2001 | Saindon | 52/204.2 |
| 6,226,940 | B1 * | 5/2001 | Biebuyck et al. | 52/235 |
| 6,318,037 | B1 | 11/2001 | Hansen | |
| 6,405,504 | B1 * | 6/2002 | Richardson | 52/461 |
| 6,409,868 | B1 | 6/2002 | Edger | |
| 6,427,398 | B1 | 8/2002 | Levine et al. | |
| 6,550,196 | B2 * | 4/2003 | Braybrook | 52/235 |
| 6,581,342 | B1 | 6/2003 | Tavivian | |
| 6,622,441 | B2 * | 9/2003 | Miller | 52/204.1 |
| 6,662,512 | B2 * | 12/2003 | Westphal | 52/204.5 |

(Continued)

OTHER PUBLICATIONS

Reid Tool Supply Company® "Reid's for Your Needs"$_{SM}$ Reid Tool—Spring 2004 Catalog (www.reidtool.com), (8 pages).

(Continued)

*Primary Examiner*—David Dunn
*Assistant Examiner*—Joshua Ihezie
(74) *Attorney, Agent, or Firm*—Blakely, Sokoloff, Taylor & Zafman LLP

(57) ABSTRACT

First and second frame sections are to be joined at a corner of a glazing. Each section has a front base piece, a rear base piece, and a glazing stop piece. The front base piece is anchored to a support structure of a building and has a glazing channel facing the safe side of the window, to receive therein the glazing. The glazing stop piece is secured to the front base piece and thereby holds the glazing in its channel. The rear base piece is secured to the front base piece and thereby laterally closes the frame section. The base pieces are shaped so that an end portion of the front base overlaps an end portion of the rear base and a number of fasteners are installed through these end portions to secure the base pieces to each other. Other embodiments are also described and claimed.

9 Claims, 27 Drawing Sheets

JAMB

U.S. PATENT DOCUMENTS

| | | | | |
|---|---|---|---|---|
| 6,922,957 | B2 * | 8/2005 | Saelzer | 52/204.1 |
| 2004/0025459 | A1 * | 2/2004 | Huebner et al. | 52/282.1 |

OTHER PUBLICATIONS

Reid Tool Supply Company® "Reid's for Your Needs"$_{SM}$ Reid Tool—Spring 2004 Catalog, Thompson™ 60 Case® Linearace® Shafts and Pacific Bearing Simplicity™ Linear Bearings, (www.reidtool.com), (4 pages).

U.S. Patent Application entitled "Explosion Resistent Window System", U.S. Appl. No. 10/241,906, filed Sep. 12, 2002, Inventor: Murray L. Neal.

U.S. Patent Application entitled "Primary Framing System and a Method of Installation", U.S. Appl. No. 10/788,716, filed Feb. 27, 2004, Inventor: Murray L. Neal.

U.S. Patent Application entitled "Window Framing System", U.S. Appl. No. 10/862,032, filed Jun. 5, 2004, Inventor: Murray L. Neal.

* cited by examiner

HEAD / UPPER JAMB

8101
HEAD / JAMB BASE

8101T
THERMAL BREAK
HEAD / JAMB BASE

8102
SILL BASE

8102T
THERMAL BREAK
SILL BASE

8201
JAMB

8201T
THERMAL BREAK JAMB

8203
SILL

8203T
THERMAL BREAK SILL

8206
MULLION COVER

8205
MULLION GLAZING STOP

8204
MULLION BASE

UPPER VERTICAL MULLION

8405
LOWER GLAZING STOP

8406
OPERABLE DOOR BASE

8410
CONTINUOUS
GEAR HINGE

WINDOW FRAME

An embodiment of the invention is directed to a window framing system that provides resistance to explosive blasts and that has the look of a double hung window. Other embodiments are also described.

BACKGROUND

In an increasingly violent society, businesses and government institutions are subject to a greater number of threats against both life and property. Such threats may be in the form of ballistic threats, explosive blasts, forced entries, as well as others. Security measures have been taken to protect against such threats. These include the installation of special windows that have increased strength, to withstand an attack. For example, windows that have security glazings that can resist certain explosive blasts, ballistic threats, and/or forced entry threats are being specified in new commercial, as well as industrial buildings.

An explosion is an extremely rapid release of energy in the form of light, heat, sound, ground shock wave and a progressive air blast shock wave. The shock wave consists of highly compressed air traveling radially outward from the source at supersonic velocities. As the shock wave expands, pressures decrease (with the cube of the distance), and when it meets a surface in line-of-sight of the explosion, it is reflected and can be amplified by several times. These pressures decay rapidly with time (i.e., exponentially) and last a very brief time, measured typically in thousandths of a second, or milliseconds. Diffraction effects, due to the presence of reentrant corners or edges of the building, may act to confine the air-blast, increasing its duration. Late in the explosive event, the shock wave becomes negative, creating suction. Behind the shock wave, where a vacuum has been created, air rushes in to fill the vacuum, creating high intensity wind or drag pressure on all surfaces of the building. It is this drag pressure that is responsible for propelling flying debris in the vicinity of the detonation. For an external explosion, a portion of the energy is also imparted to the ground, creating a crater and generating a ground shock wave analogous to a high-intensity, short duration earthquake.

The shock wave is the primary damage mechanism of an explosion. The pressure it exerts on building surfaces may be several orders of magnitude greater than the loads for which the building is designed. The shock wave also acts in directions, which the building may not have been designed for, such as upward on the floor system. In terms of sequence of response, the air-blast first impinges on the weakest point in the vicinity of the device closest to the explosion, typically the exterior envelope of the building, and usually the window and/or door locations are the first to fail prior to progressive wall collapse. The explosion initially pushes on the exterior walls at the lower stories and may cause window breakage and/or wall failure. As the shock wave continues to expand, it enters the structure, pushing both upward and downward on the floors.

Glass is often the weakest part of a building, breaking at low pressures compared with other components such as the floors, walls, or columns. Past incidents have shown that glass breakage may extend miles for large external explosions. This is due to the seismic loading or shock wave that propagates by particle velocity. High velocity glass fragments have been shown to be a major contributor to injuries in such incidents. For incidents within downtown city areas, falling glass poses a major hazard to passersby and prolongs post-incident rescue and clean up efforts by leaving tons of glass debris on the street.

For an explosive threat defined by its charge weight in pounds of TNT equivalent, W, and its distance from the target, or stand off, R, the peak pressure and impulse of the shock wave are evaluated using scaling charts available in military handbooks. The impulse is defined as the area under the pressure verses the time curve (i.e., the integral of pressure with respect to time). The impulse is an indicator of how long the air-blast acts on the target, information that is needed for evaluating its response. The duration of the loading, td, may be defined as the duration of a linearly decaying function having the peak impulse, I, and pressure, P, of the actual air-blast (i.e., td=2I/P). Because this duration differs somewhat from the actual duration (which is based on an exponentially decaying function), it is referred to as an "equivalent" duration. Windows that are designed to withstand such explosive blasts may also present better resistance to natural disasters such as hurricanes, tornadoes, and severe storms.

Conventional windows that call for security glazings have a primary frame to secure a glazing unit, within a defined opening of a building, for example. The frame is referred to as a "primary" frame because it may be the only frame that is needed to close the given opening between a "threat side" and a "safe side". Where the threat side is outside of the building, and the safe side is inside the building, the primary frame serves not only to secure the glazing, but to also weatherproof the opening.

BRIEF DESCRIPTION OF THE DRAWINGS

The embodiments of the invention are illustrated by way of example and not by way of limitation in the figures of the accompanying drawings in which like references indicate similar elements. It should be noted that references to "an" embodiment of the invention in this disclosure are not necessarily to the same embodiment, and they mean at least one.

FIG. 16 is an elevation view of a dual pane, fixed window according to another embodiment of the invention.

FIG. 28 is an elevation view of another single/double hung look, blast resistant window.

FIG. 32 is an elevation view of a blast resistant, casement window.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

In this section, several embodiments of the window framing system are described with reference to the figures. The framing system of FIG. 1 should preferably be implemented using formed steel pieces, while those shown in FIGS. 6, 16, 28, and 32 are preferably made of extruded aluminum (however, in all cases, alternative materials are possible). In the case of the latter embodiments, the framing system has an advantageous, modular design that allows the sharing of structural frame cross-sections among different types of windows, as well as among the different sides of a window frame. For example, the base and glazing stop pieces shown in cross-section in FIG. 7 may be used, with relatively minor changes at most, in a number of different applications, including left and right jamb sections, head section, upper and vertical mullion sections, as well as the sill section of the window of FIG. 6. A slightly modified version of this base piece design is also used for the window of FIG. 16, in the jamb and head sections. This allows a single, extrusion production line to be used, using a single die having orifices that define the desired cross-section of a beam. This beam may then be cut at different points along its longitudinal axis, to form a number of pieces that may be combined, as shown, for example, in the figures, to form one or more blast resistant window frames. The cross-section of each beam is designed so that it can be reusable in the different applications. Although extruding is the current preferred technique for manufacturing the beams of the latter two embodiments (FIGS. 6 and 16), other types of metal forming may be used to create the different pieces having the cross-sectional structure illustrated and described here.

In most cases, the frame pieces are secured either to each other and/or to the building support structure by means of fasteners such as screws or concrete anchor bolts. The sectional views illustrate an example lateral positioning of such fasteners, lateral in this case meaning within a plane that is perpendicular to the longitudinal axis of a particular frame piece. It is then understood that there may be multiple instances of such fasteners spaced longitudinally along the length of each frame piece, as needed to withstand a given type of explosive blast situation. A greater number of fasteners, together with smaller spacing between adjacent ones, may be installed for higher blast resistance.

Figure 1:
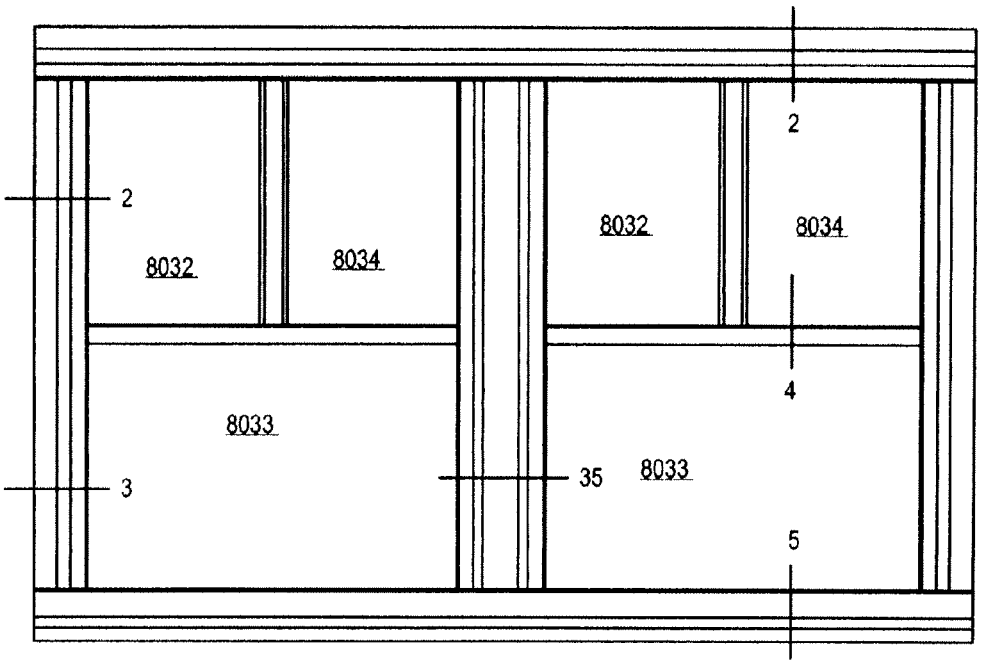
FIG. 1 is an elevation view from the threat side of a fixed, double hung look window according to an embodiment of the invention.

In the example of FIG. 1, the window frame has left and right jamb sections that are joined to a head section at one end and to a sill section at another, each at a respective corner of a glazing. In this particular case, there are a total of six glazings that are supported by the frame. In other embodiments, however, there may be as few as two, namely just an upper glazing 8032 and a lower glazing 8033. In yet another embodiment, there may be just four glazings, two on the left and two on the right of a center, vertical mullion section, where each end of the mullion section is to be joined to a respective one of the head and sill sections. The example six-glazing embodiment here has three glazings supported on each side of the vertical mullion, namely glazings 8032-8034, where glazings 8032 and 8034 are separated by an intermediate vertical mullion, and these two glazings are separated from the lower, larger glazing 8033 by a horizontal mullion.

Figures 11A, 11B:
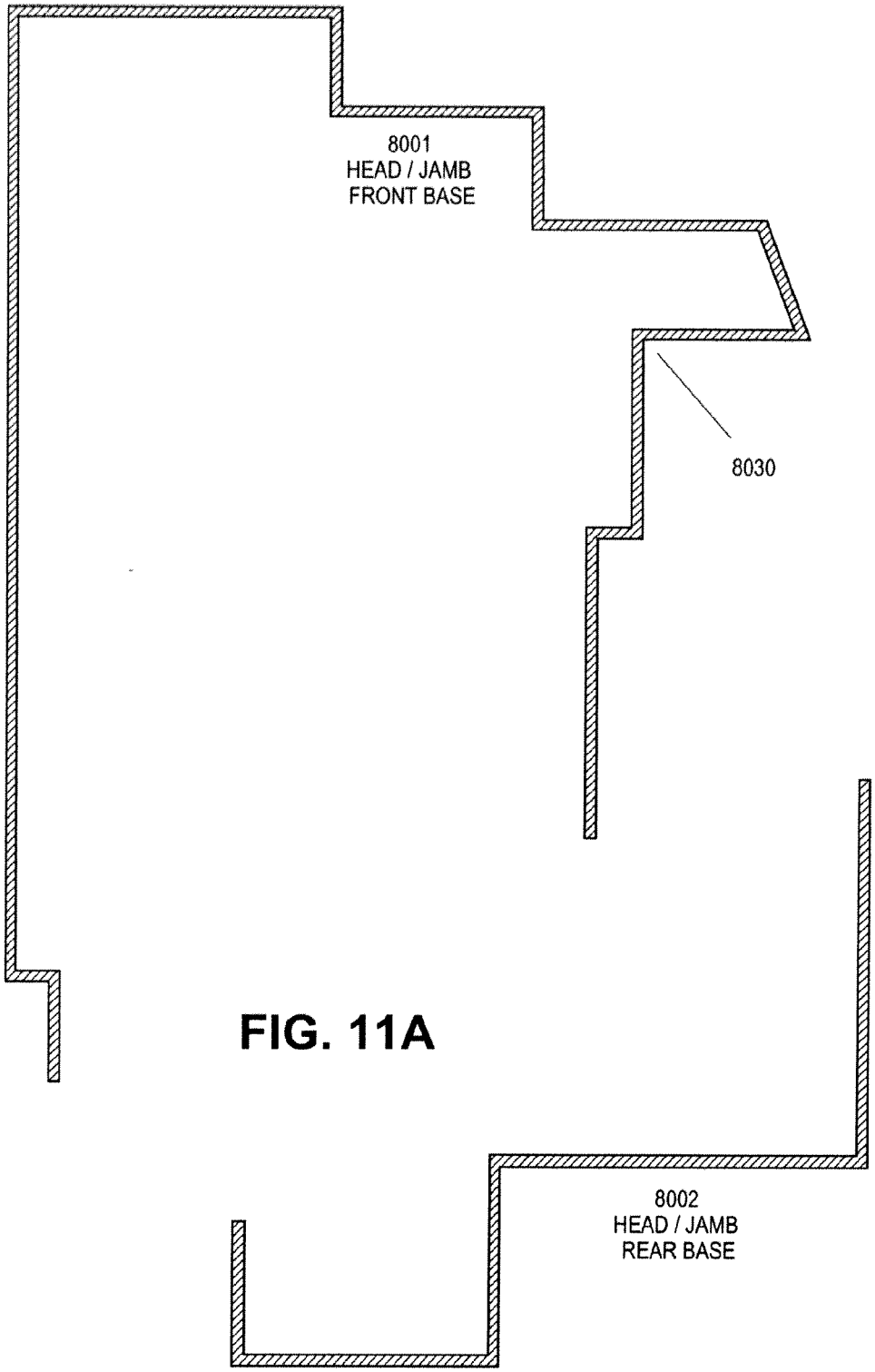
FIGS. 11A and 11B have close up views of the head/jamb front base and head/jamb rear base pieces, for the window of FIG. 1.

Different sectional views of the example multiple light window of FIG. 1 are illustrated in FIGS. 2-5, and 11A and 11B. Each sectional view shows the aspects of a frame piece that, in most cases, run the full length of the piece (hence suitable for extrusion). Beginning with FIG. 2, this sectional view of an upper jamb piece, or alternatively, a head piece, illustrates a front base piece 8001 and a rear base piece 8002. A screw 8018 (or other suitable fastener) is passed through a hole in a left side of the base piece 8001, and threaded into a left side of an opening in a support structure of a building, to anchor the base piece. The front base piece 8001 is secured to the rear base piece 8002 to thereby laterally close the jamb section. Close up views of the base pieces 8001 and 8002 are shown in FIGS. 11A and 11B. In this example, the two base-pieces are secured at two different locations. A screw 8014 (or other suitable fastener) is passed through an opening in the left side walls of the pieces 8001, 8002. Another attachment location is on the right side walls, using screw 8015. For better weather proofing, a first thermal isolator block 8022 is sandwiched between the front and rear base pieces at the latter location. A second thermal isolator block 8021 is sandwiched between the base pieces on the left side walls at the location of screw 8014. Note that another way to describe how the two base pieces are secured to each other is that they are attached to each other in one location that is close to the building support structure and in another location that is near a glazing channel 8030.

The channel 8030, in this example, is formed in the right side wall of the front base piece 8001, and faces the safe side of the window. This is also referred to as an "inside set" embodiment, where the glazing 8032 can be placed in position within its channel from the inside of the building structure. As an alternative, the window can be fully "unitized" prior to being shipped to the building job site, i.e. the glazing is installed and secured in place prior to anchoring the base piece 8001 to the building support structure. Note that although not shown, some form of adhesive or sealant material is preferably provided in contact with the glazing 8032 and the surface of the channel 8030, to not only help secure the glazing in place, but also provide weather proofing. Examples include double-sided, closed cell high density very high bond (HD-VHD) foam tape 8019 and 8020 (see FIG. 3). Once the glazing 8032 has been placed within its channel as shown, a glazing stop piece 8011 rests against the glazing 8032 and, in this example, the right side wall of the near base 8002, and should be secured to both the front and rear base pieces 8001, 8002 using, for example, a suitable fastener (e.g., one or more screws 8016 that are passed through their corresponding through holes as shown).

Figure 2:
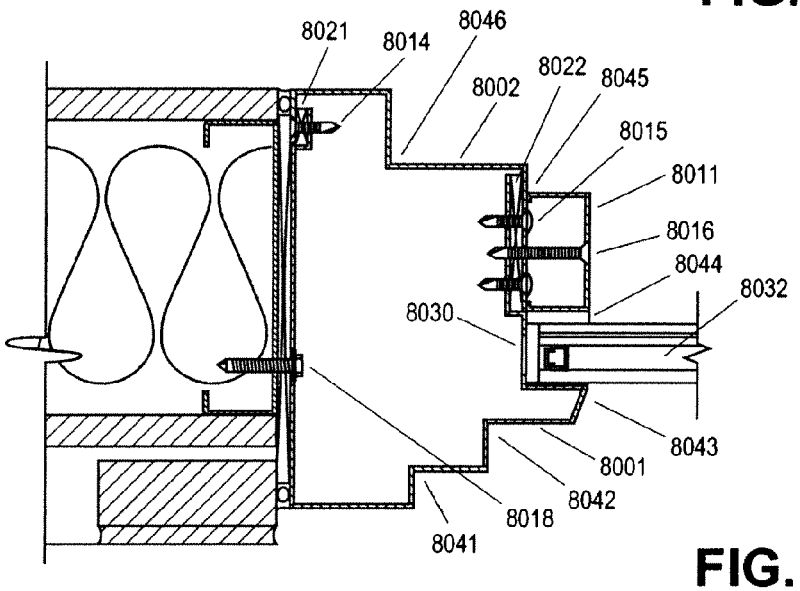
FIG. 2 is a sectional view of an upper jamb section, or alternatively a head section, of the window.

Still referring to FIG. 2, both the front base 8001 and rear base 8002 have a "stepped" look, where these "steps" start at the support structure of the building and proceed towards the glazing 8032. At the front, there are three steps 8041-8043, while at the rear there are also three steps 8044-8046. As an alternative, a different architectural look may be imparted (to the threat side and safe side) that has a fewer or even greater number of steps, formed in the front and rear base pieces.

Figure 3:
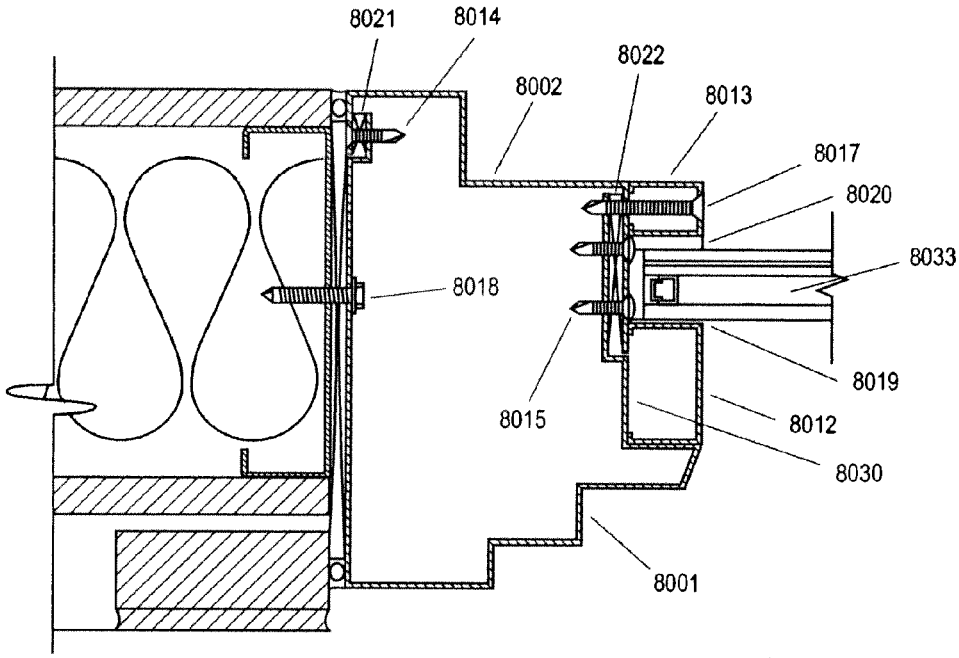
FIG. 3 is a view of a lower jamb section showing a lower glazing of the window, positioned so as to be behind an upper glazing (not shown).
Figure 25:
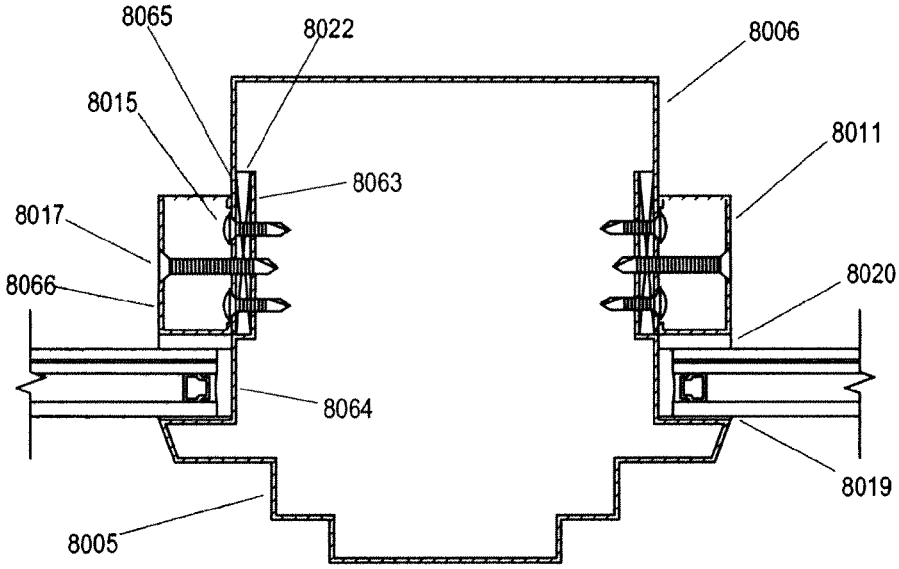
FIG. 25 is a sectional view of an upper vertical mullion for the window of FIG. 1.

Turning now to FIG. 3, a sectional view of a lower jamb section of the window of FIG. 1 is shown. The same front and rear base pieces 8001, 8002 support a lower glazing 8033, in the same glazing channel 8030. To provide the double hung look, the glazing 8033 is held vertically in a plane that is slightly behind (and parallel to) the upper glazing 8032. This is achieved by a glazing in-fill piece 8012 being sandwiched between the glazing 8033 and the rear facing surface of the channel in the front base piece 8001. A thin piece of adhesive material 8019 (such as double sided, closed cell HD-VHB foam tape) joins the front facing surface of the glazing 8033 to a rear facing side of the in-fill piece 8012, while in this example, a slightly thicker piece of adhesive material 8020 joins the rear facing side of the glazing 8033 to a front facing side of a glazing stop piece 8013. The glazing stop piece 8013 is further secured in place by a fastener 8017, such as a screw that threads into a corresponding opening in at least one and preferably both of the front and rear base pieces 8001, 8002. A similar arrangement to that shown in FIGS. 2 and 3 may be used in an intermediate vertical mullion (such as the one holding two lower glazings 8033 side-by-side, and upper glazings 8034, 8032 side-by-side, as in the embodiment of FIG. 1). FIG. 25 is a sectional view of such a mullion.

As seen in FIG. 25, this example upper vertical mullion has two main pieces, a front piece 8005 and a rear piece 8006. A respective glazing channel is formed by a bend 8064 on the left and right sides, where these face the safe side of the window. The middle of the front piece 8005 may have one or more bends for a particular aesthetic profile (intended in this example to give a stepped look to the threat side). Each end of the front piece 8005, beyond the bend 8064, has a portion 8063 that overlaps with a corresponding portion 8065 at an end of the rear piece 8006. The front and rear pieces are secured to each other at these overlapping portions, to laterally close the mullion. A number of screws 8015 (or other suitable fastener) are passed through aligned openings in the overlapping end portions as shown (where it is understood that in the length direction, there may be several screws 8015 spaced longitudinally, their number and relative spacing being selected in view of a desired blast resistance). This is similar to the mechanism shown in FIG. 2 for the head or upper jamb piece. In the same manner, the glazing may be secured in place within its channel by a glazing stop piece 8011 that in turn is secured to both the front and rear base pieces 8005, 8006 using, for example, a number of suitable fasteners (e.g., screws 8017 that are passed through their corresponding, aligned holes in a side face 8066 of the stop piece 8011 and the overlapping portions of the base pieces as shown).

Figure 4:
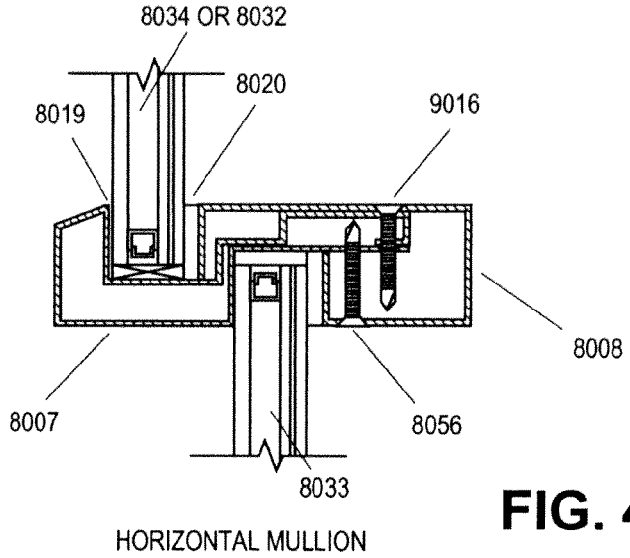
FIG. 4 is a view of a horizontal mullion that attaches to and secures upper and lower glazings of the window.
Figure 23A:
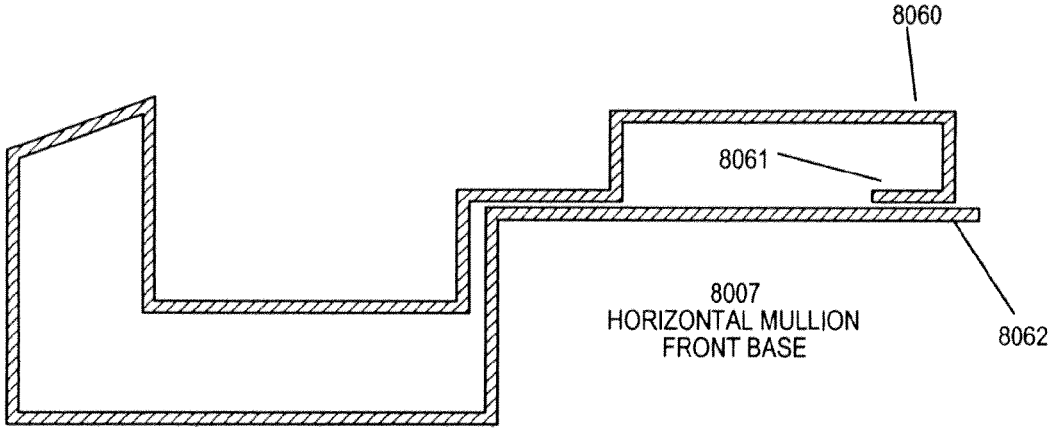
FIGS. 23A and 23B are close up views of the horizontal mullion base pieces used in the window of FIG. 1.
Figure 23B:
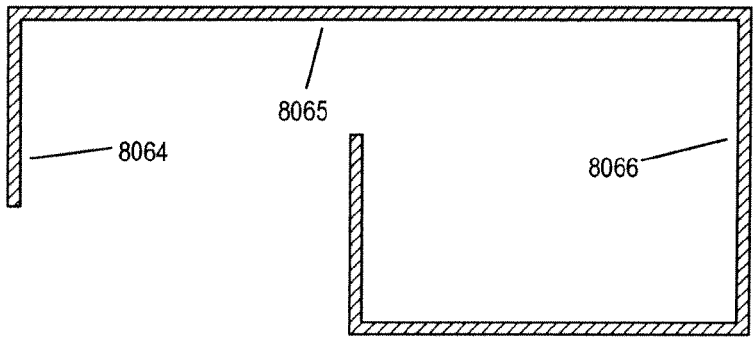

Turning now to FIG. 4, a sectional view of a horizontal mullion of the embodiment of FIG. 1 is shown. Note how the upper glazing 8032 or 8034 is held, with respect to the lower glazing 8033, namely in parallel to each other yet spaced to the rear, by a combination of horizontal mullion front and rear base pieces 8007 and 8008. Close up views of these are shown in FIG. 23. The mullion base pieces may also be made of steel, by bending a plate of steel into the shape shown in FIG. 23. Referring now to FIG. 4, there is no need for a separate glazing stop piece, because, for example, the glazing 8032 is held within its channel (formed in the front base piece 8007) by a left side wall 8064 of the rear base piece 8008 (FIG. 23). The left side wall 8064 is rigidly connected to the right side wall 8066 of the mullion rear base piece 8008 by a transverse section 8065. The transverse section 8065 is in turn secured to, in this example, up to three separate sections 8060-8062 of the front base piece 8007. These three sections 8060-8062 are all located to the right of the vertical plane defined by the lower glazing 8033 (once installed, see FIG. 4). A fastener such as a screw 8016 in this case passes through all three sections 8060-8062, and through the transverse section 8065 of the rear base piece 8008 for a secure attachment. As an alternative, there may be fewer sections of the front base piece that are used to receive the fastener (e.g., using only, for example, section 8060, and not 8061 and 8062). For additional strength, a further series of fasteners 8056 may be added between the fastener 8016 and the lower glazing 8033, which passes through corresponding (aligned) openings in the front and rear base pieces.

Figure 5:
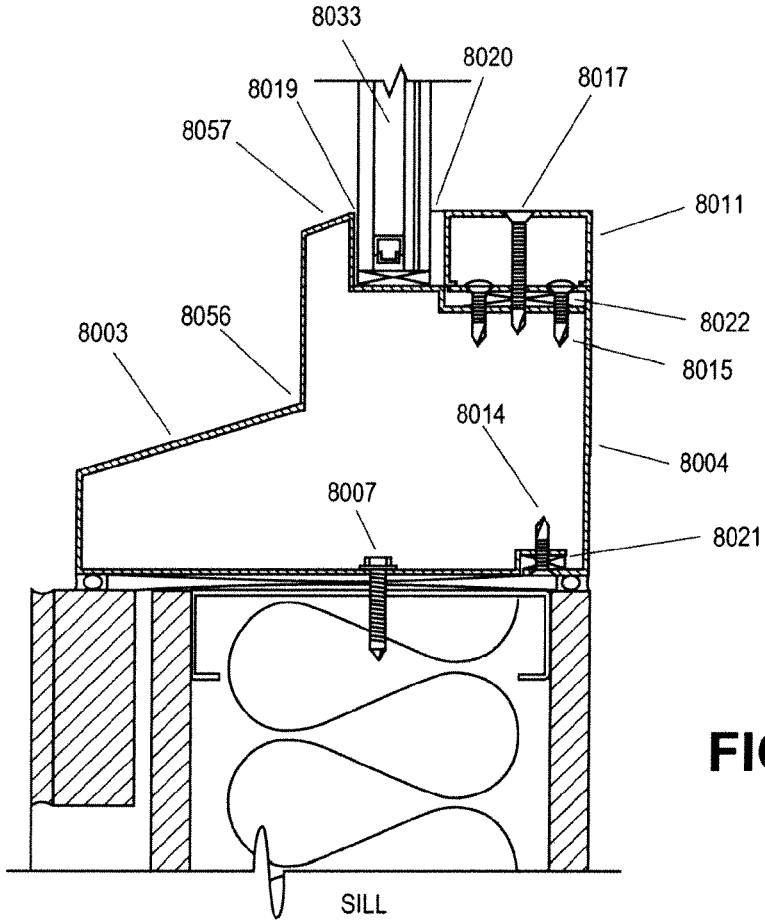
FIG. 5 is a view of the sill section of the window.

Lastly, for this embodiment, FIG. 5 shows a sectional view of the sill section of the window. Again, a two piece solution is provided here, namely a front base piece 8003 and rear base piece 8004. The glazing channel in this case holds a pair of lower glazings 8033, side-by-side (see FIG. 1), and is formed in a top facing side of the front base piece 8003. To help shed rain and condensation from the threat side of the window, the sections of the front base piece to the left of the glazing channel are angled downwards as shown. Note that in this case, the architectural look has called for a two-step design (step portions 8056 and 8057), although as an alternative a single step or more than two steps may be formed in the front base piece.

Still referring to FIG. 5, the lower glazing 8033 is held in place by a glazing stop piece 8011 which is secured to overlapping sections of the front and rear base pieces 8003, 8004 by a fastener 8017. These overlapping sections are further secured to each other by additional fasteners 8015. A thermal isolator block piece 8022 is also sandwiched between the overlapping sections. The structure of FIG. 5 is somewhat similar to that of FIG. 2 in that the front and rear base pieces, which are to be secured to each other to laterally close the sill section, are secured at two overlapping sections that are located close to the building support structure (using a fastener 8014) and close to the glazing channel (fastener 8015).

Figure 6:
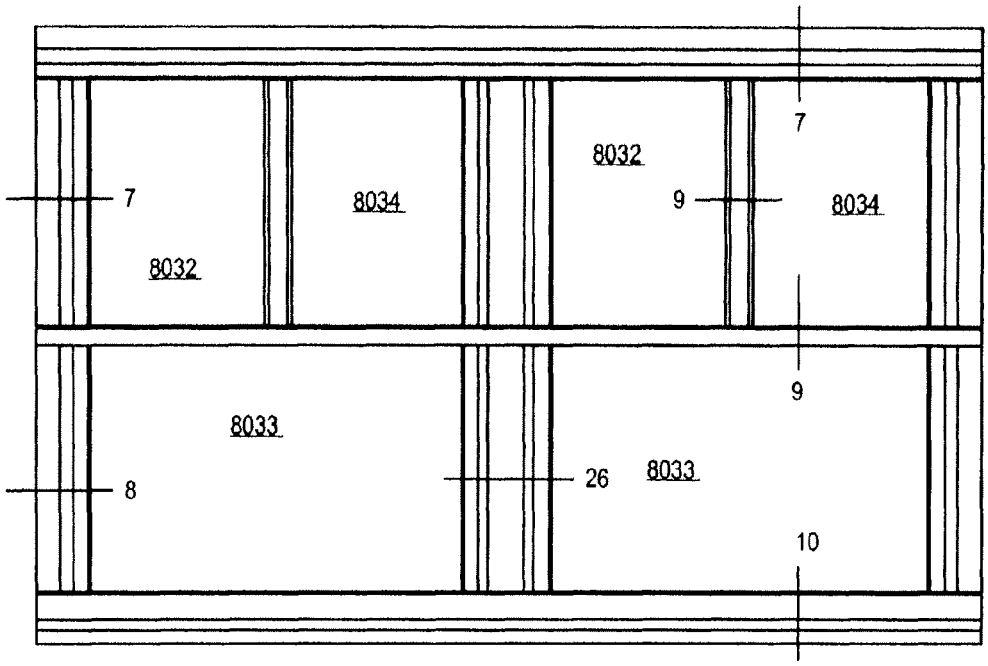
FIG. 6 is an elevation view of a double hung look, fixed window, according to another embodiment of the invention.
Figure 7:
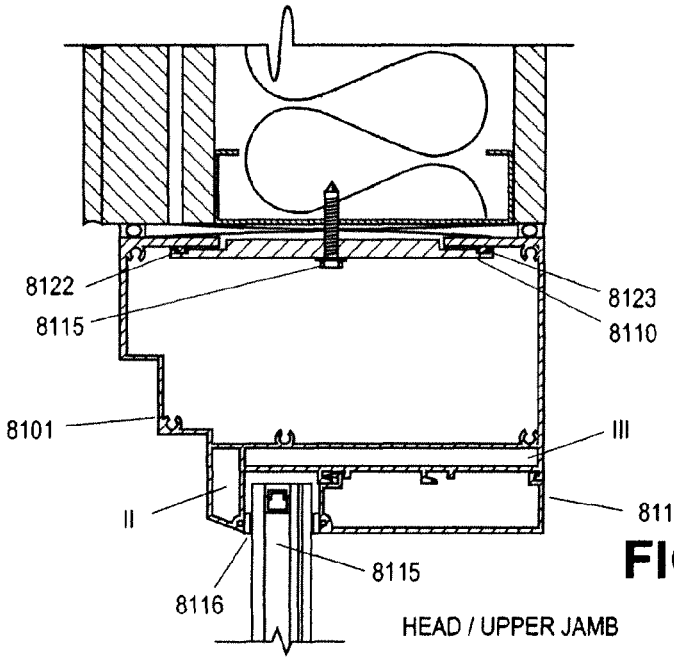
FIG. 7 is a view of an upper jamb section, or alternatively, a head section, of the window of FIG. 6.

Turning now to FIG. 6, another embodiment of the window framing system is shown whose frame pieces are particularly suitable for extruding. This is also a fixed, six-pane window with a double hung look (same as FIG. 1). Once again, an advantageous, modular design allows the sharing of the cross-sectional shape of a structural frame piece among different types of windows, as well as among different sides of the frame. For example, FIG. 7 illustrates a sectional view of an upper jamb section, as well as a head section of such a window. The base piece 8101 (with a detailed view in FIG. 12) has essentially the same cross-section for the jamb, as well as the head sections of the window. In this case, the cross-sections are not just the same shape, but also have the same dimensions. The base piece 8101 is not laterally closed, but rather has a lateral opening 8120 in the side that is facing the building support structure (see FIG. 12). That is because the opening is used for both a thermal break (in the depth direction) and at the same time enhancing the anchorage system, using a base plate 8110. The base plate 8110 has front and rear overlapping portions 8122, 8123 that overlap with front and rear end portions 8126, 8125 of the base 8101, respectively, when the base plate 8110 has been installed within the cavity of the base piece 8101. A thermally insulative material may be sandwiched between those overlapping portions to achieve the thermal break. An island formed between these overlapping portions is sized such that there is a gap (in the depth direction) between the island and the edges of the end portions 8126, 8125 (when the plate is installed as shown).

The base plate is used for stronger anchoring of the jamb or head section to the building support structure. A number of fasteners 8115 are installed through the base plate 8110 and into the building structure, along the length of the jamb or head section. Because it may be thicker (or if not thicker, may be made from a stronger material) than the end portions 8126, 8125 of the base piece 8102, the plate 8110 as installed provides greater resistance to direct shear and torsion when the glazing bows in and twists against the frame (in the positive phase of a blast.)

Figure 12:
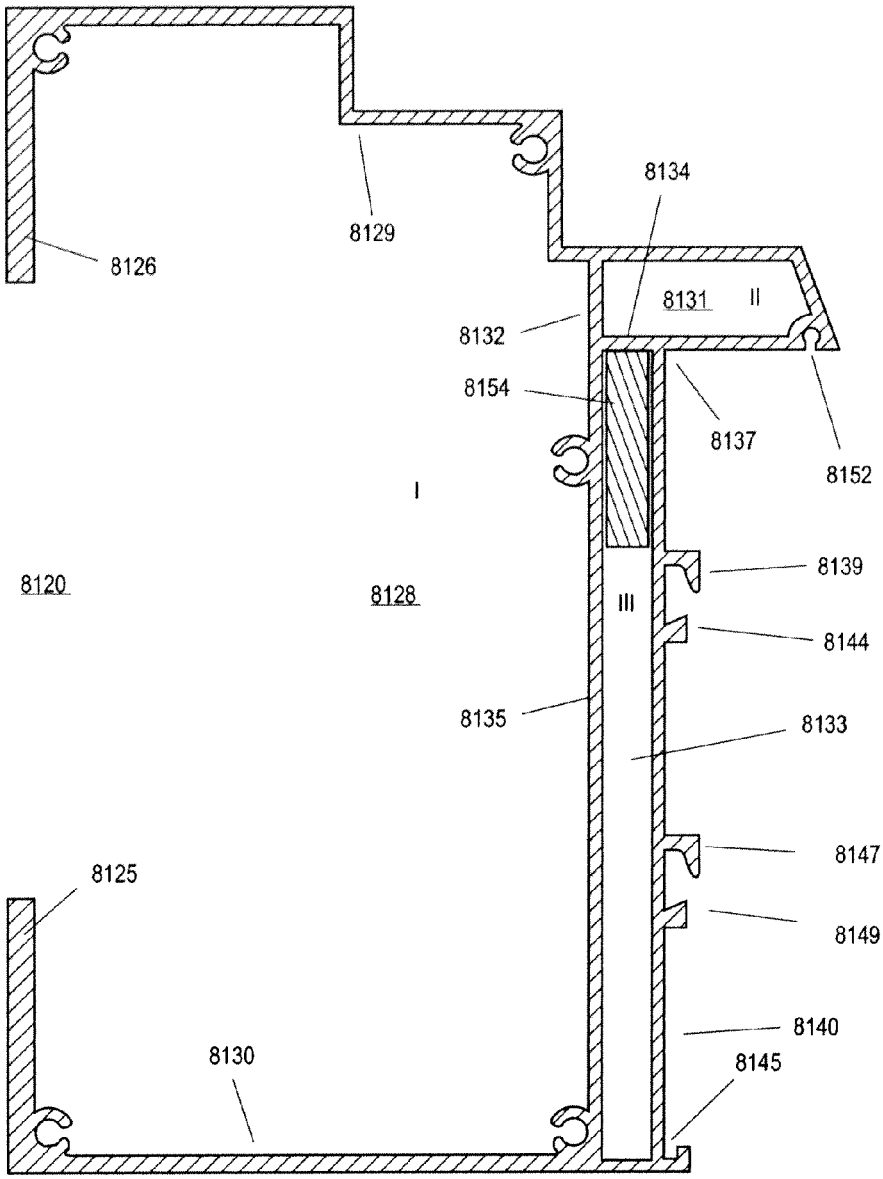
FIG. 12 is a close up view of the head/jamb base piece of the window of FIG. 6.

Still referring to FIGS. 7 and 12, the base piece has a first cavity 8128 (I) with a front wall 8129 and a rear wall 8130. A second cavity 8131 (II) shares a wall 8132 with the first cavity 8128. A third cavity 8133 (III) shares a wall 8134 with the second cavity II and another wall 8135 with the first cavity I. The third cavity III is located to the rear of the second cavity II, and in this example, is entirely screened off by the second cavity II. As an alternative, portions of the third cavity III could extend beyond, that is to the left and right of, the second cavity II. A glazing channel 8137 lies beside the third cavity, as opposed to behind or in front thereof, and faces the safe side of the window. The channel 8137 is to receive therein a glazing 8032 (or alternatively, glazing 8034, or, as another alternative, lower glazing 8033, see FIG. 6). In this embodiment, the second cavity 8131 is located behind the front wall 8129, and where intersecting walls of the second and third cavities 8131, 8133 define the glazing channel 8137. Compare, with the embodiment of FIG. 16 to be described below, and in particular FIG. 17 where the glazing channel is defined differently. For architectural purposes, the third cavity III does not extend rearward, beyond the rear wall of the first cavity I, to provide a single plane on the rear side of the window frame (facing the safe side). For the same reason, a glazing stop piece 8111 also does not extend rearward, beyond the rear wall of the first and third cavities (see FIG. 7). The cavity III may be sleeved for improved blast resistance, by a shear block 8154 that is inserted longitudinally and located, preferably, against the wall 8134. This shear block 8154 may be in addition to any angle shear blocks that are inserted into the cavity III or cavity II at a corner of the frame (for joining, for example, a jamb piece to a head piece), and may run the full length of the base piece.

Figure 24A:
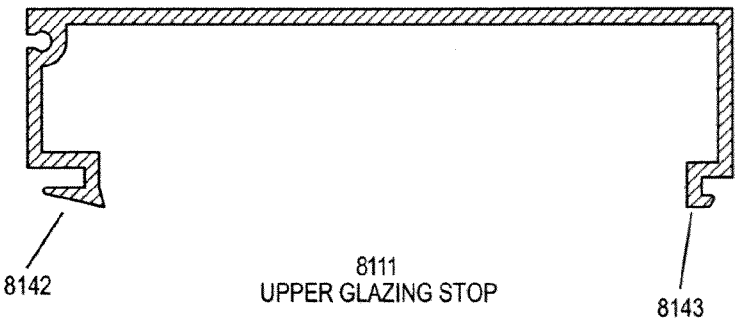
FIGS. 24A, 24B and 24C are close up views of glazing stop pieces used in the embodiment of FIG. 6.
Figure 24B:
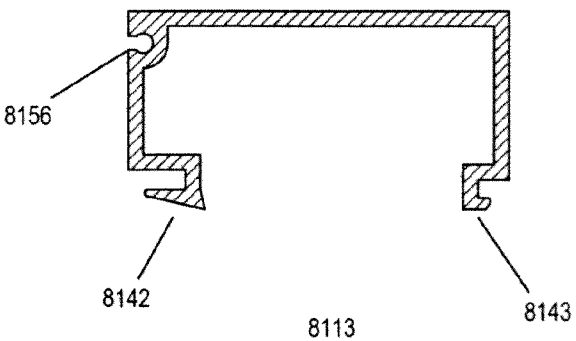
Figure 24C:
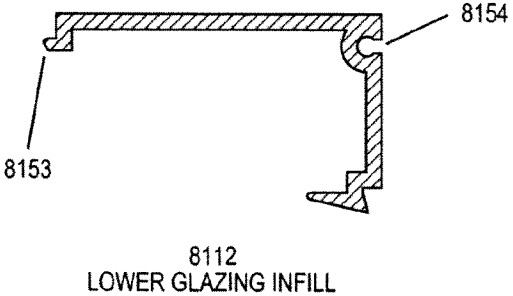

The glazing stop piece 8111, in addition to securing the glazing 8032, also acts as an aesthetic cover and can advantageously be installed in a relatively easy manner by being snap fitted into place as shown. Referring now to FIG. 12, a first retaining portion 8139 extends out from a surface of a right facing side wall 8140 of the base piece 8101, to form a pocket whose opening faces the rear. This retaining portion 8139 is to receive therein a finger 8142 of an upper glazing stop piece 8111, see FIGS. 24A, 24B and 24C. The finger 8142 is formed at the front of the glazing stop piece 8111, in relation to a rear facing tab 8143 formed at its rear. The glazing stop piece 8111 thus has a substantially U-shape in cross-section, and runs essentially the full length of the piece. The rear facing tab 8143 snaps into a forward facing pocket 8145 located at the rear of the base piece 8101, on the surface of the right side wall 8140 (see FIG. 12). In addition, a lip 8144 is formed just behind the retaining portion 8139 and that runs substantially the entire length of the base piece 8101. The lip 8144 is also on the surface of the side wall 8140 and is positioned and sized so that a backside of the finger 8142 (FIG. 24A) is to rest against it when the glazing stop piece 8111 has been installed to secure the glazing within its channel. The lip or resting portion helps prevent the glazing stop from popping out of its place, during the positive and negative phases of an explosive blast. The combination of the first retaining portion 8139, lip 8144 (also referred to as resting portion), and forward facing pocket 8145 together provide an easy mechanism for snap fitting the upper glazing stop 8111 (FIG. 24A) to the base piece 8101 to not only secure the glazing within its channel even during an explosive blast event, but also provide an aesthetic cover on the safe side of the window, along the entire length of the base piece.

Staying with FIG. 12, the base piece 8101 also has a second retaining portion 8147 that forms a second pocket on the surface of the right side wall 8140. This second pocket is located between the first pocket (formed by retaining portion 8139) and the forward facing pocket 8145. The second pocket is used as described below with reference to FIG. 8, for receiving the corresponding finger 8142 of a lower glazing stop piece 8113 (see FIG. 24B). The second pocket is also backed up with a second lip 8149 located just behind the second retaining portion 8147 and in front of the forward facing pocket 8145.

Figure 8:
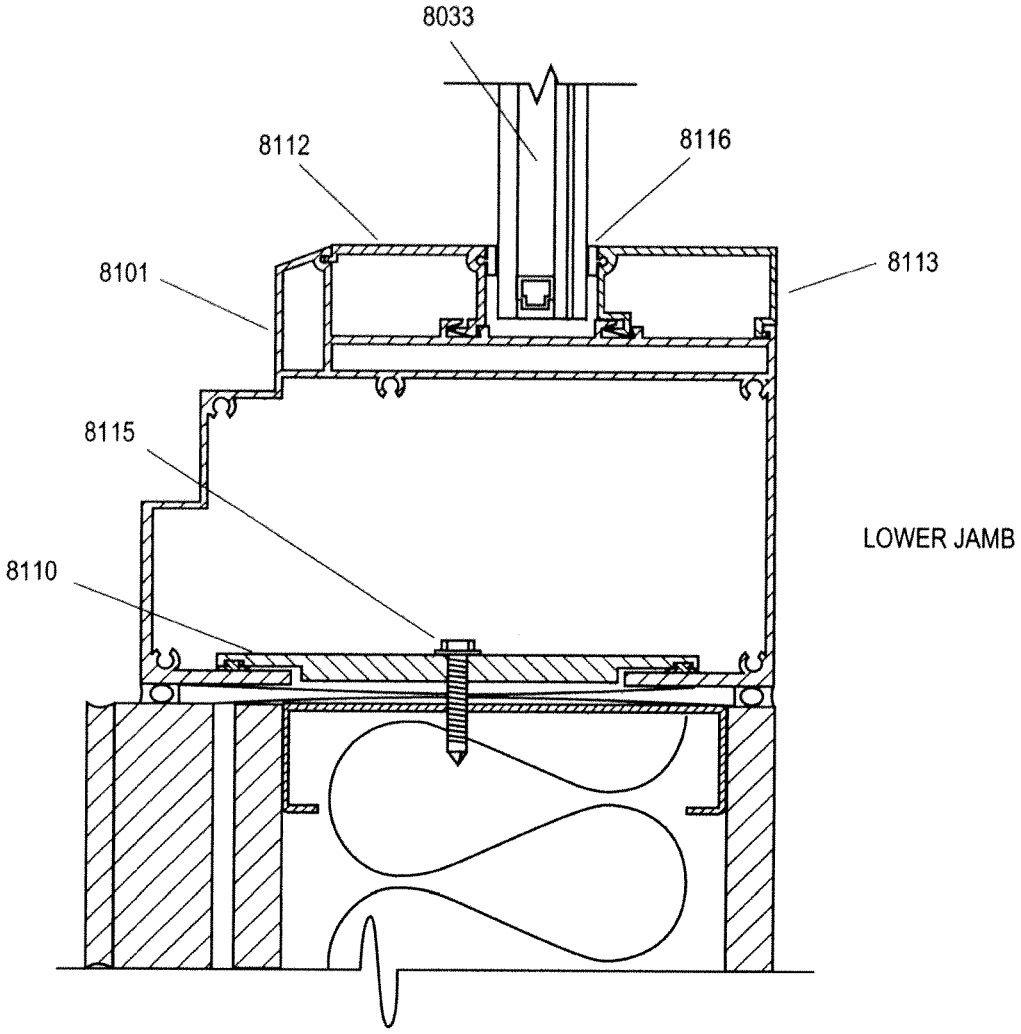
FIG. 8 is a view of the lower jamb section of the FIG. 6 window.

Turning now to FIG. 8, a lower jamb section of the window of FIG. 6 is shown which holds the lower glazing 8033 in place. The base piece 8101 may be the same as the one in the upper jamb section, in other words, a single jamb piece extends from the head to the sill section of the window (FIG. 6), where the lower jamb section, in this case, holds the lower glazing 8033 in a plane that is parallel to but behind that of the upper glazing 8032 thereby providing a double hung look. The window, however, is fixed in that the lower glazing 8033 is secured in place between a lower glazing in-fill piece 8112 and a lower glazing stop piece 8113, both of which are attached to the surface of the side wall 8140 of the base piece 8101 (as described above using retaining portions 8139, 8147, and forward facing pocket 8145, FIG. 12). The step-back look is provided by the lower glazing in-fill 8112 being snap fitted into place as shown, with its forward lip 8153 (FIG. 24C) fitting into a reglet 8152 (FIG. 12) that is formed in a rear facing segment of the glazing channel. Note this reglet 8152 is also used, in the upper jamb section and the head section (FIG. 7), to fit therein an EPDM sponge gasket 8116 (or other durable, weather resistant material). Similar reglets 8154 and 8156 are formed on a rear facing side of the lower glazing in-fill piece 8112, and a forward facing side of the lower glazing stop piece 8113 (FIG. 24B) to receive similar gaskets 8116 against the opposite sides of the glazing 8033 (FIG. 8).

Figure 26:
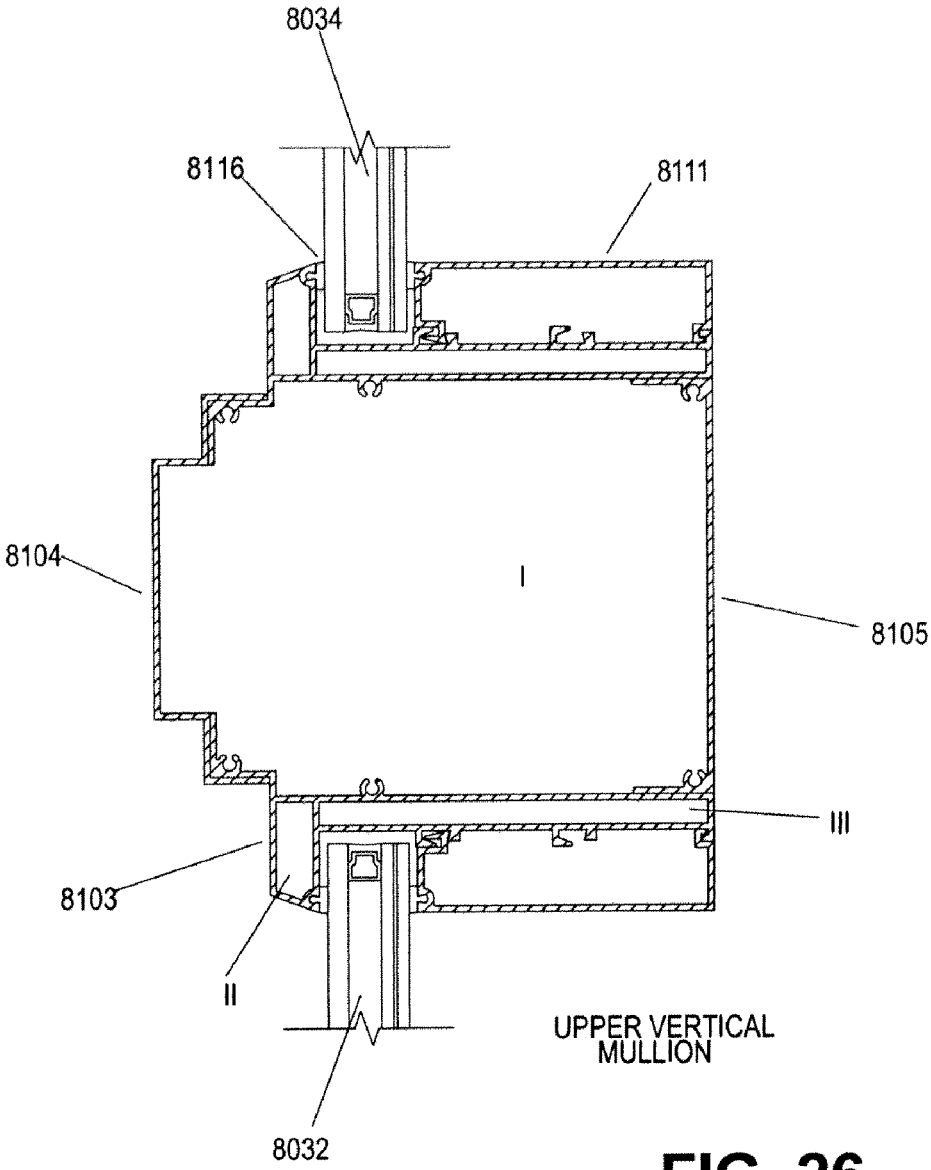
FIG. 26 is a view of an upper vertical mullion of the window of FIG. 6.
Figures 27A, 27B, 27C, 27D:
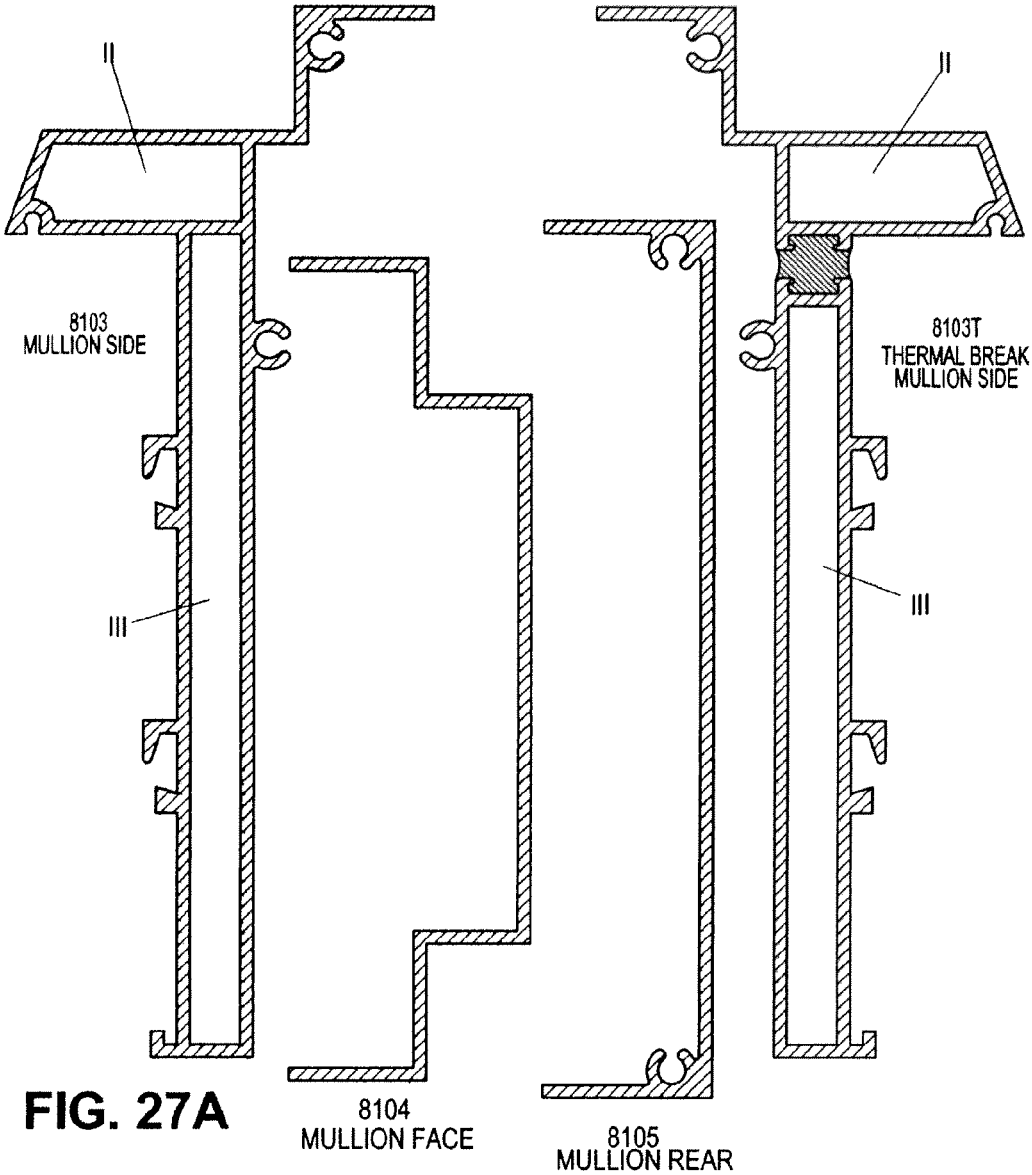
FIGS. 27A, 27B, 27C and 27D are close up views of mullion pieces for the window of FIG. 6.

Turning now to FIG. 26, the upper vertical mullion of the window of FIG. 6 is shown as it holds the upper glazings 8032, 8034 in place. The vertical mullion is shared by the upper and lower halves of the window in the same manner as is the jamb piece depicted in FIGS. 7 and 8. The base portion of the mullion may be divided into the same three cavities I, II, and III, except that in this case, cavity I is shared by the left and right sides of the mullion as shown. The mullion is created in this example by four pieces, namely a mullion face 8104, a mullion rear 8105, and two mullion sides 8103 (one on the left and another on the right). See FIGS. 27A, 27B, 27C and 27D for close up views, where an optional mullion side with a thermal break between cavity II and cavity III is also shown. The mullion side 8103 is a single piece, preferably extruded, that contains the fully enclosed cavity II and cavity III, as well as the glazing channel for its particular side. The mullion rear 8105 rigidly connects the mullion sides at the rear, while the mullion face does the same for the front, thereby laterally closing the entire structure. These four pieces may be rigidly affixed to each other using some form of welding technique for example. Note how for this particular architectural profile, the mullion rear 8105 is completely flush, that is planar, with the rear faces of the glazing stop pieces 8111, while the mullion face 8104 and mullion sides 8103 define a three step look (described also above with respect to FIG. 2).

Figure 9:
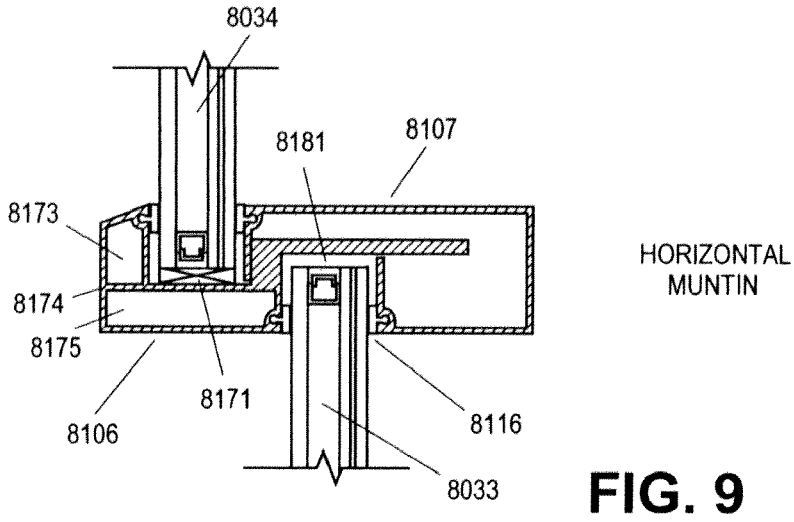
FIG. 9 shows the horizontal muntin of the FIG. 6 window.

Moving now to FIG. 9, a sectional view of the horizontal muntin used in the embodiment of FIG. 6 is shown. The muntin is composed of at least two pieces, a muntin base piece 8106 which is a pan-shaped piece with a channel 8171 defined in its top side to receive the glazing 8034, and a muntin cover piece 8107 that acts not only as a glazing stop piece but also as an aesthetic cover for the safe side of the window that hides the pan handle portion of the base piece 8107. The muntin base 8106 has one or more laterally closed, weight saving cavities, in this case a forward cavity 8173 and a rear cavity 8175. In this particular example, these cavities share a horizontally oriented wall 8174. As an alternative, the shared wall may be vertical. In most cases, the glazing channel 8171 is defined by intersecting walls of these cavities 8173, 8175.

To support the lower glazing 8033, another glazing channel 8181 is defined in a bottom facing side of the muntin base 8106. A rear portion of the muntin cover 8107 serves as a glazing stop for the glazing 8033, with a weather gasket 8116 lodged in a reglet on a forward facing side of the muntin cover 8107. The muntin cover 8107 thus wraps around, as viewed from the safe side, the muntin base 8106, starting at the inside surface of the upper glazing 8034 and ending at the inside surface of the lower glazing 8033, thus also serving as an aesthetic cover.

Figure 10:
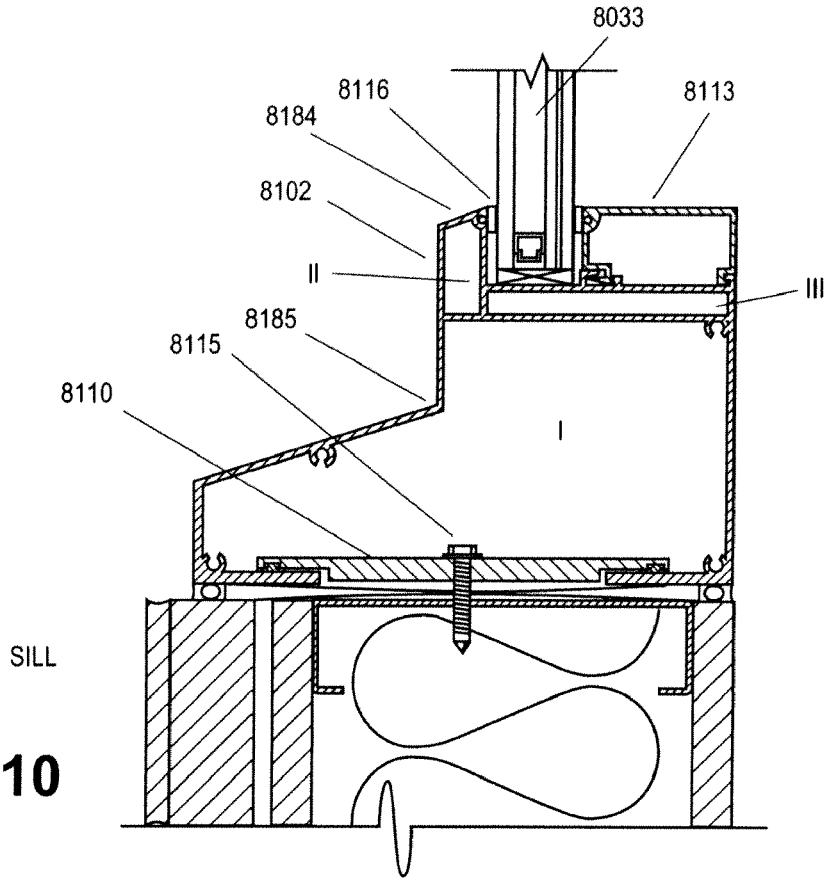
FIG. 10 shows a sill section of the window of FIG. 6.
Figure 14:
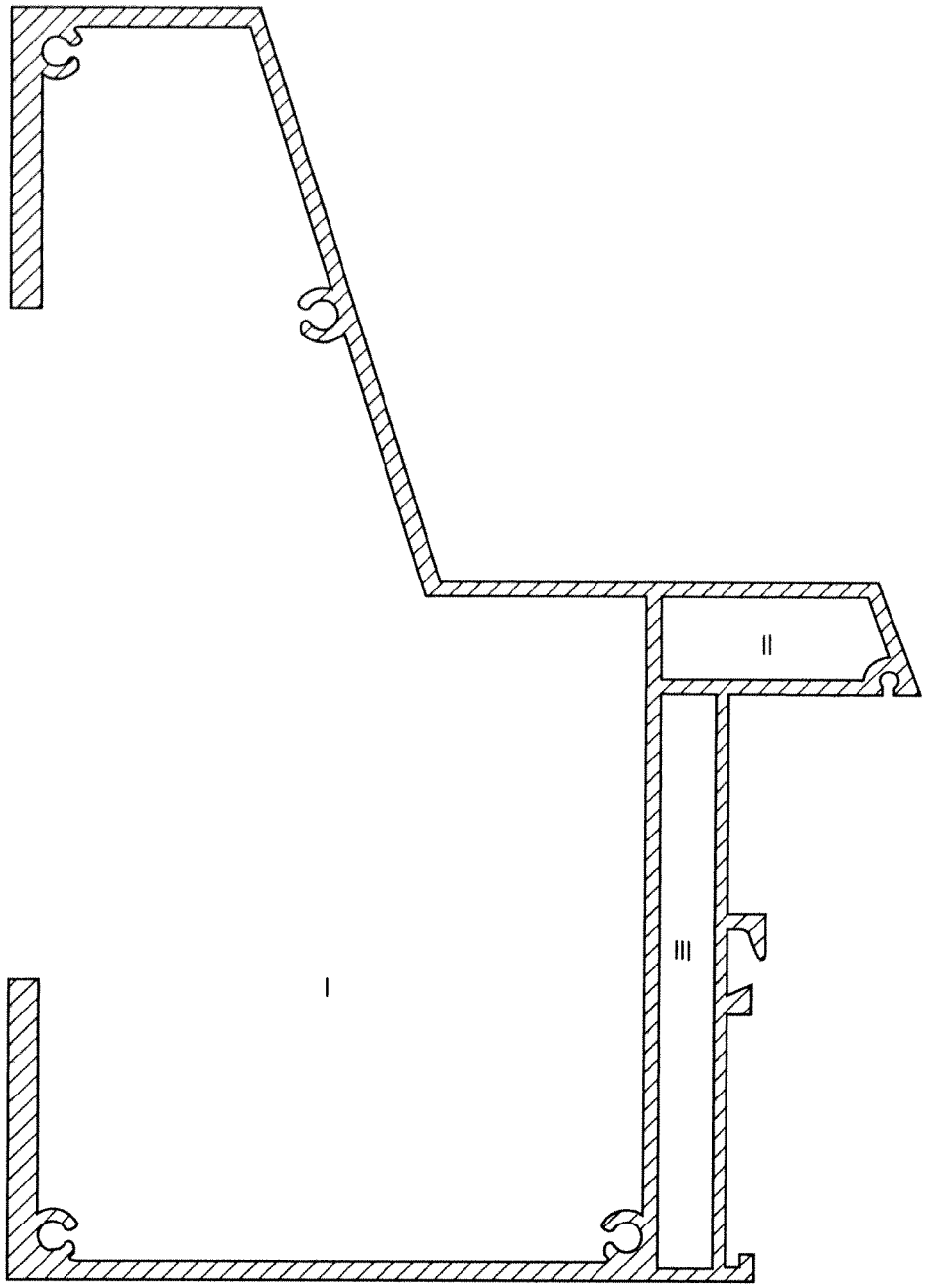
FIG. 14 is a close up view of the sill base piece of the window of FIG. 6.

Turning now to FIG. 10, a sectional view of the sill section of the window of FIG. 6 is shown. The sill base piece 8102 has a somewhat different cross-sectional shape than that of the head or upper jamb pieces (FIG. 7) although the sill base piece 8102 also has cavities I, II, and III in essentially the same orientation as they are in FIG. 7. Also, the glazing stop piece 8113 has the same cross-section as that used in the lower jamb section (FIG. 8), which is shorter but has the same cross-section as the piece 8111 used in the head and upper jamb sections (FIG. 7). This is consistent with the stepped-back look of the window at, in this example, its lower end. In addition, the front of the base piece 8102 defines at least two steps, in this case, a first step 8184 near the glazing 8033, and a second, lower one 8185, with both being angled downwards to help shed rain and condensation on the threat side. See FIG. 14 for a close up view of the sill base 8102.

Figure 15:
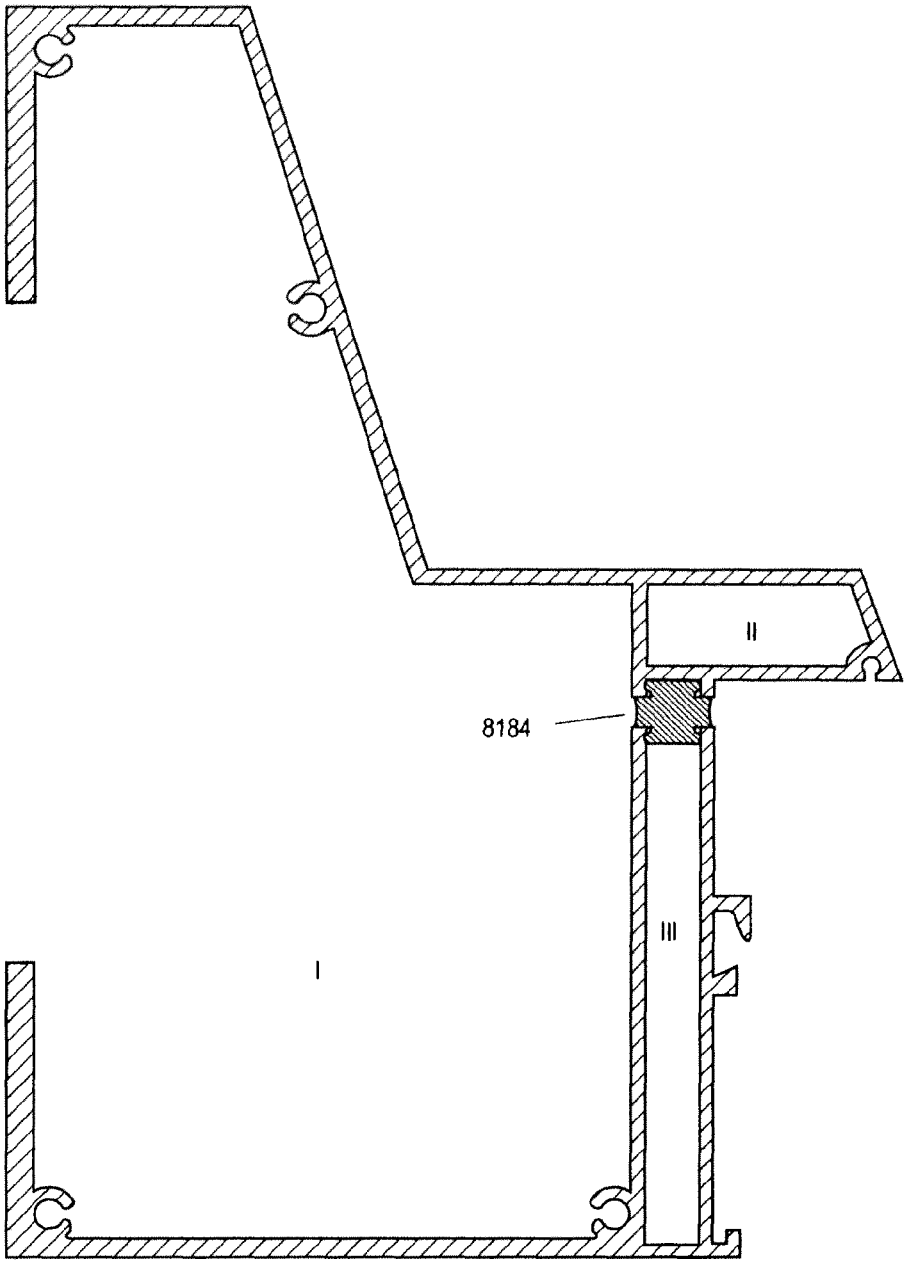
FIG. 15 shows a sill base piece for the window of FIG. 6, with a thermal break.

Both the head/jamb base pieces 8101 (FIG. 12) and the sill base 8102 (FIG. 14) have alternative embodiments that contain a thermal break 8184 positioned between the cavity II and III. See FIGS. 13 and 15 for close up views of such head/jamb and sill base pieces, with a thermal break. In these particular examples, the thermal break includes thermally insulating material that has been filled into a cavity having on one side a wall shared with the cavity III and on the other a wall shared with the cavity II. Other ways of forming a thermal break in the side wall of a base piece that is near the glazing channel (as opposed to the side wall that is near the building support structure) are possible.

Turning now to FIG. 16, an elevation view of a fixed window framing system is shown, according to another embodiment of the invention. Beginning with a sectional view of the jamb in FIG. 17, the base piece 8201 has a first cavity (I) with a front wall 8215 and a rear wall 8217. A cavity I also shares a side wall 8219 of the cavity III. See FIGS. 18A and 18B for a close up view.

As in the embodiments of the base piece used for the window of FIG. 6, the base piece 8201 also has a second cavity II that shares a wall with the first cavity I and is located in front of the third cavity III. In this case, however, the second cavity II is laterally open, into the glazing channel, because it serves as a weep channel to collect moisture that may have trickled essentially vertically down the threat side or safe side face of the glazing (and passed by the gaskets 8210). The weep channel is most effective in collecting moisture in the sill condition depicted in FIG. 19. To drain the collected moisture, a number of round holes or slots may be drilled into the front wall 8129 (see FIG. 20).

Figure 17:
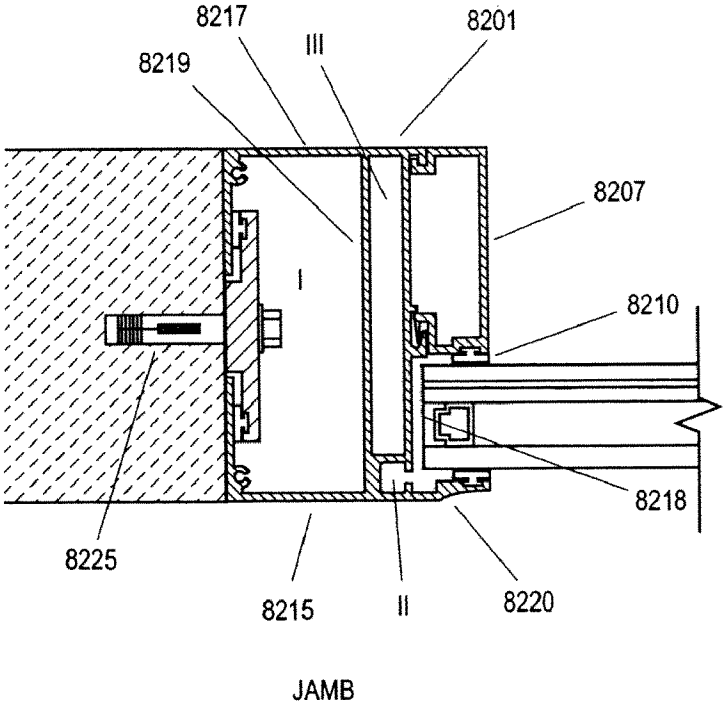
FIG. 17 shows a left jamb section of the window of FIG. 16.
Figure 18A:
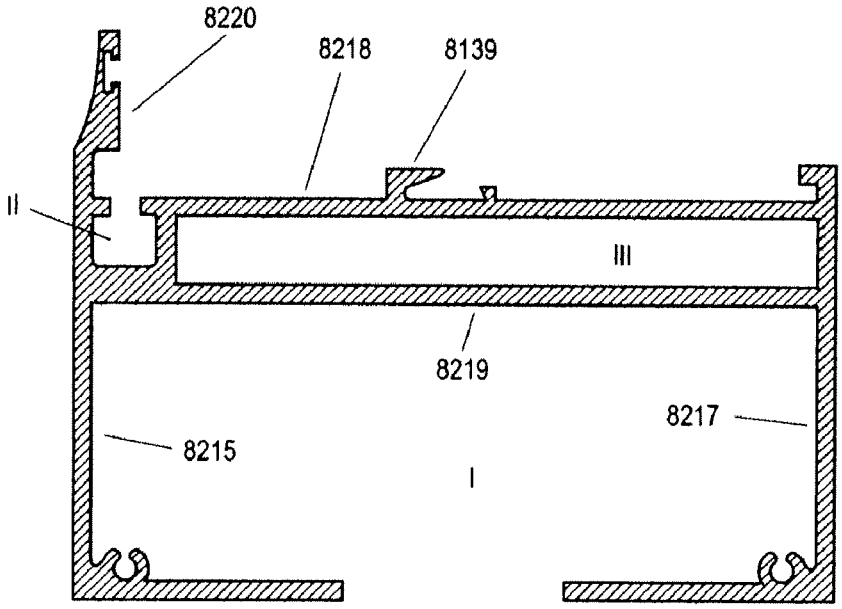
FIGS. 18A and 18B are close up views of two jamb base pieces for the window of FIG. 16, including one with a thermal break.
Figure 18B:
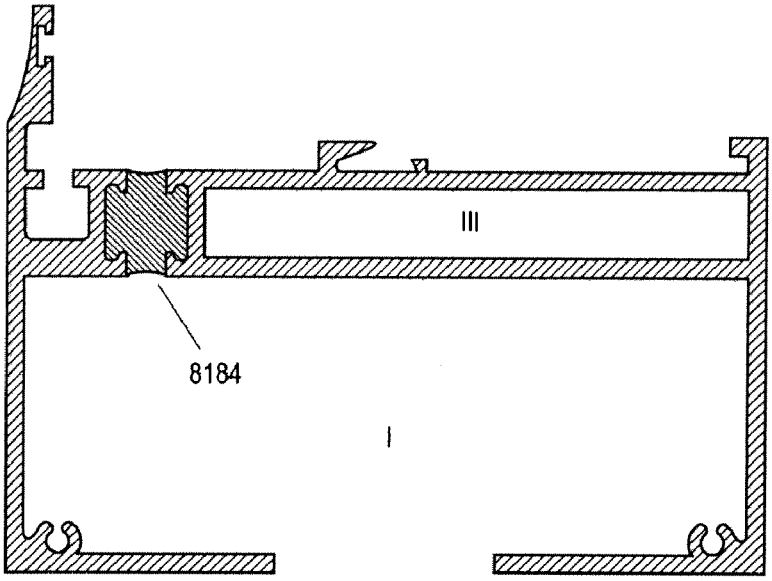

Still referring to FIGS. 17 and 18A and 18B, the glazing channel faces the safe side of the window, and is formed, in part, by the intersection of the right facing side wall 8218 and an extension portion 8220 that extends to the right and in front of the third cavity III. The side wall 8218 also has on its surface the first retaining portion 8139, formed as seen in FIG. 18A beside the cavity III, defining a rear facing pocket that is to receive a forward facing finger of the glazing stop piece 8207 (FIG. 17).

Referring to FIG. 18B, another embodiment of the jamb base piece 8201 is shown, with a thermal break 8184 formed between the second cavity II and the third cavity III in a depth direction of the base piece, beside the first cavity I. In this particular embodiment, the thermal break spans the entire width of the third cavity III.

Figure 19A:
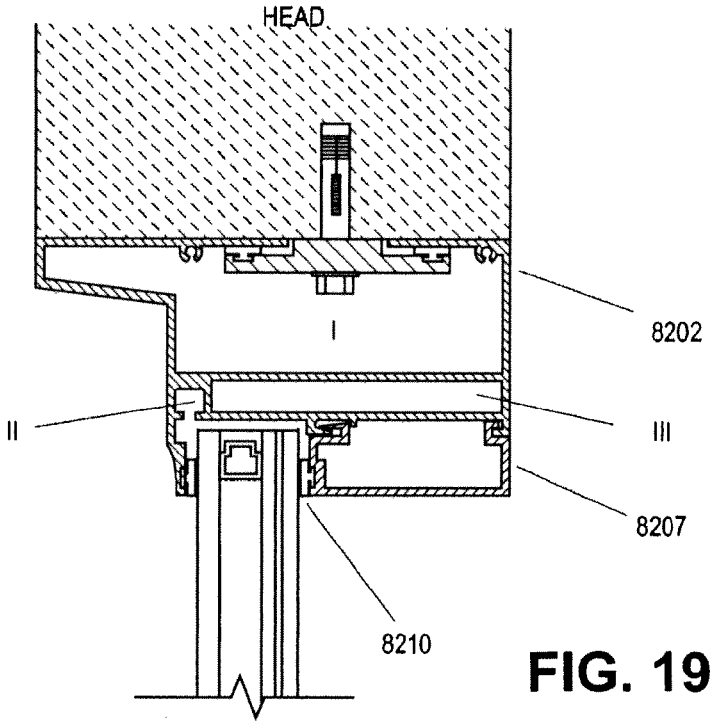
FIGS. 19A and 19B are a sill or alternatively a head section of the window of FIG. 16.
Figure 19B:
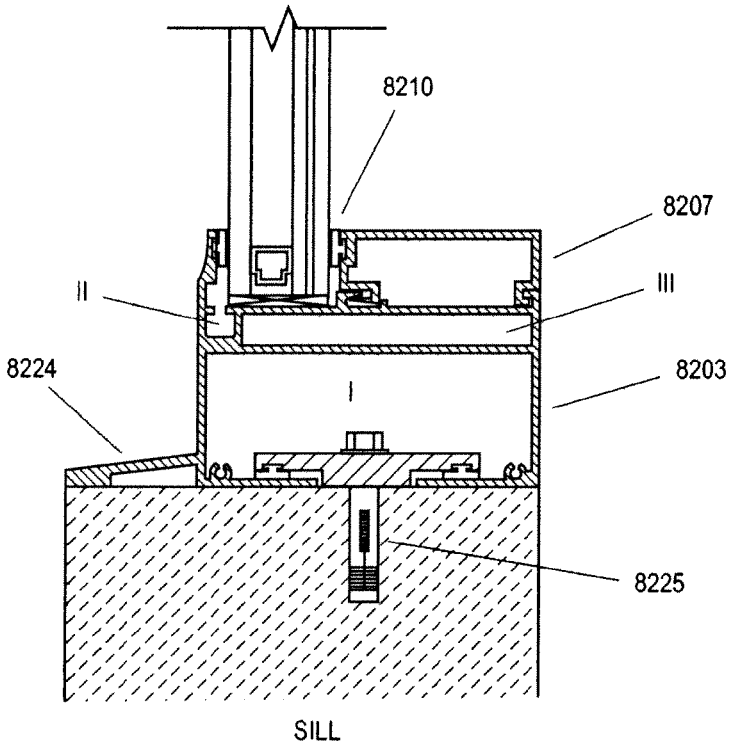
Figure 20A:
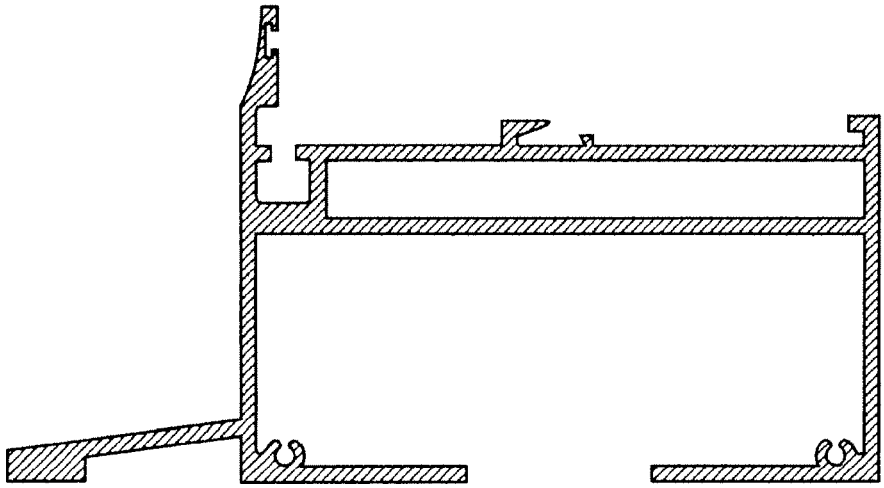
FIGS. 20A and 20B are close up views of two sill base pieces for the window of FIG. 16, one with a thermal break.
Figure 20B:
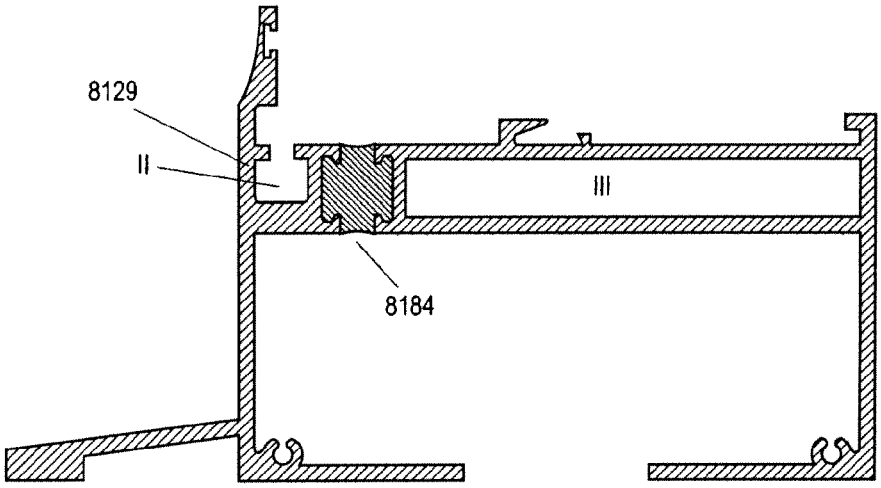

Turning now to FIGS. 19A and 19B, a sectional view of the sill section of the window of FIG. 16 is shown. The cross-section is substantially the same as that of the jamb section of FIG. 17, except that for aesthetic reasons, a ledge 8224 extends from the front of a base piece 8203, in front of the first cavity I. The ledge 8224 may be easily incorporated in the extrusion process to adapt essentially the same base piece to the architectural needs of certain regions of the U.S. The ledge 8224 has a slight downward slope (downward to the left or threat side) to help shed rain and condensation from the threat side of the window. The glazing is held in its channel in the same manner as in FIG. 17, namely by a glazing stop piece 8207 that also acts as an aesthetic snap cover, with a weather gasket 8210 having been installed within a reglet in the front facing side wall of the glazing stop piece 8207. Similar to FIG. 18B, a thermal break 8184 may be formed between the cavity II and the cavity III in the base piece 8203. (See FIGS. 20A and 20B).

It should be noted that the base pieces 8201, 8203 of the embodiment of the window of FIG. 16, shown in FIGS. 17 and 19A and 19B, may be anchored to the building support structure, prior to installing the glazing within the channels. A fastener 8225 (in this case a concrete anchor bolt) has been inserted through the side wall of the base piece that faces the building support structure, in a lateral location that is close to the front wall 8215. To drive a bolt into such a location, access is available only from the front of the base piece 8201. Accordingly, the fasteners 8225 in this location would need to be installed prior to installing the glazing. As an alternative, however, a "unitized" window could be installed by positioning an anchor plate (such as the anchor plate 8110 of FIG. 7) inside the cavity I. The fasteners 8225 would then be installed through this anchor plate into the building support structure, at locations that are near the middle (as measured in a depth direction) of the base piece 8201, 8203, and hence easily accessible from behind the glazing. With a unitized window the glazing could be installed within its channel at the factory and then shipped to the building construction job site. The unitized window would then be positioned within its opening, followed by anchoring the jamb, sill and head base pieces to the building support structure. A structural sealant preferably a dual compound quick cure such as Dow Corning 983 is applied to hold the glazing within its channel temporarily until the unitized window is delivered to the job site, at which point the window is centered within the opening and secured to the building support structure, followed by installing the glazing stop piece/aesthetic snap covers 8207.

Figure 21:
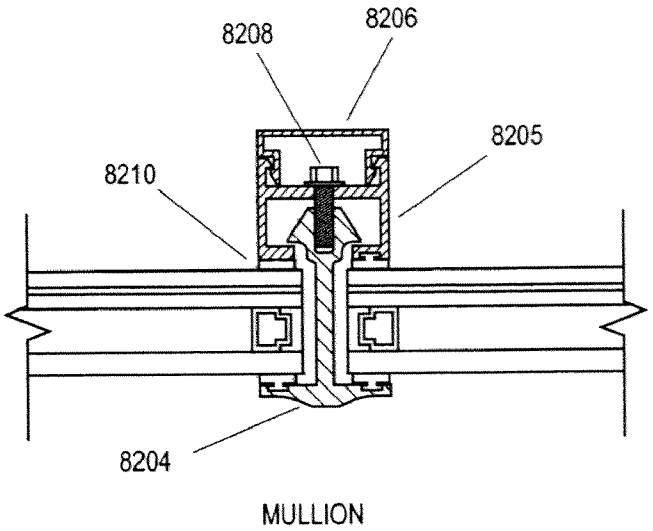
FIG. 21 is a view of the mullion of the window of FIG. 16.
Figure 22C:
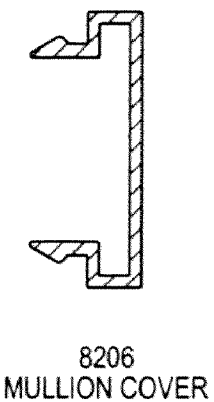
FIGS. 22A, 22B and 22C are close up views of a base piece, glazing stop, and cover for the mullion in FIG. 21.
Figure 22B:
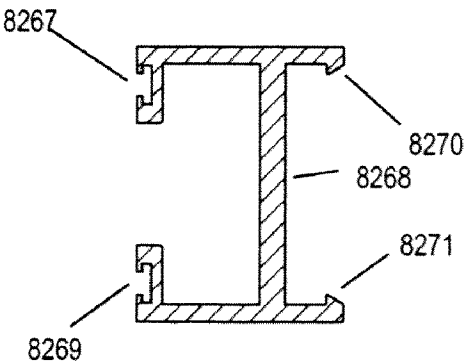
Figure 22A:
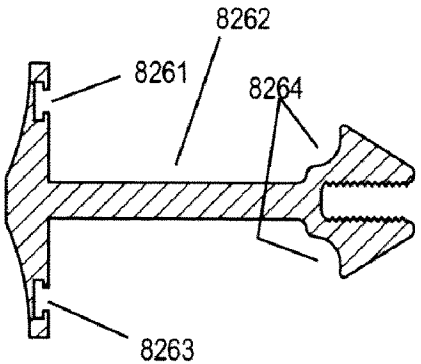

Another aspect of the window of FIG. 16 is the vertical mullion depicted in FIG. 21. A T-shaped mullion base piece 8204 has first and second glazing channels formed on the left and right sides of a stem portion 8262 as shown. Referring now to FIGS. 22A, 22B and 22C where close up views of the mullion components are shown, the mullion base 8204 has a pair of reglets 8261, 8263 formed at opposite ends of the hat portion of the T-shaped base and facing the rear. A hook portion 8264 is formed on opposite sides of the stem 8262, towards the rear of the base piece, behind the glazing channels. A C-shaped glazing stop piece 8205 is to be secured to a backside of the hook portion 8264 to hold a pair of glazings within their respective channels. See FIG. 21. The glazing stop 8205 is secured to the hook portion 8264 by a fastener 8208 that is inserted through a hole in the body portion 8268 of the C-shaped glazing stop piece, and into a corresponding hole (e.g., one that is threaded, to receive a machine screw) in a backside of the hook portion 8264. A second pair of reglets 8267, 8269 are formed at the front of the glazing stop piece 8205 and face forward. Each reglet is to receive a piece of weather gasket 8210 that will rest in contact with a surface of the glazing.

Note that the hook portion 8264 is wider than the mouth of the C-shaped glazing stop piece 8205, to further help preclude the base piece 8204 from being pulled out of the glazing stop 8205 during an explosive blast event. In addition, one or more tabs, such as 8270 and 8271, are formed at the far rear end of the glazing stop piece 8205, to hold via a snap-fit an aesthetic mullion cover piece 8206.

Figure 29:
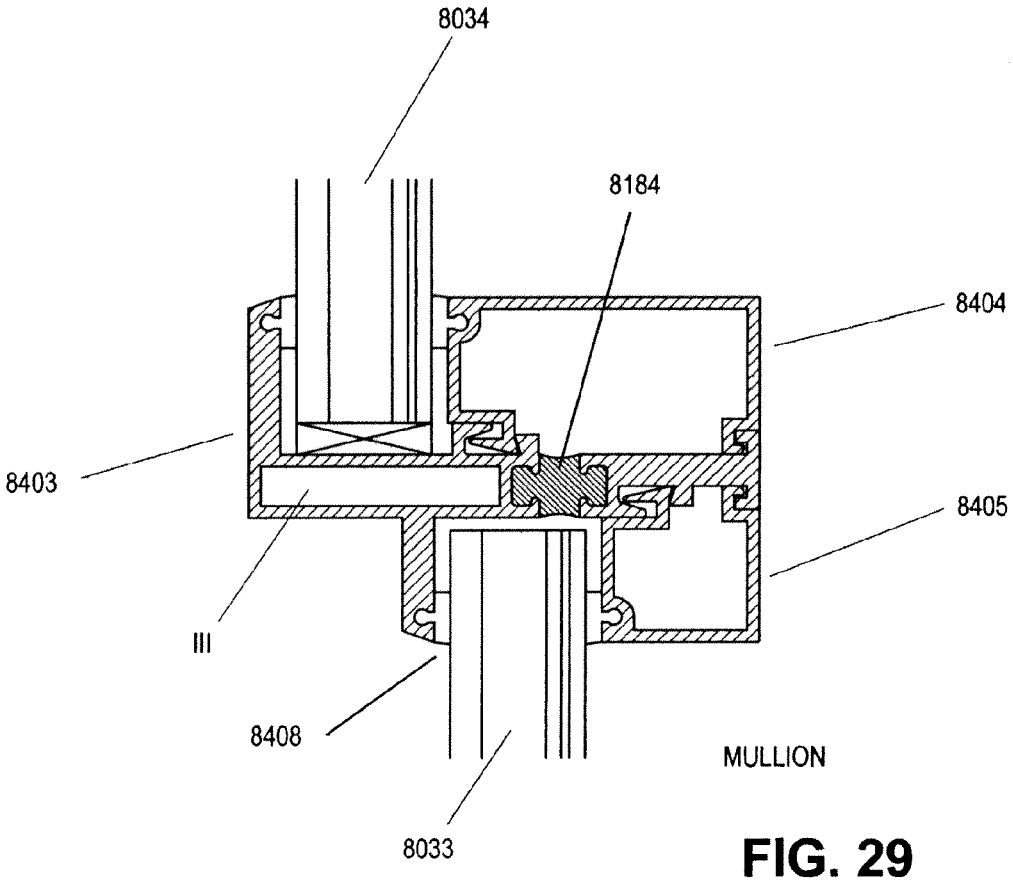
FIG. 29 is a view of a horizontal mullion for the window of FIG. 28.
Figure 30:
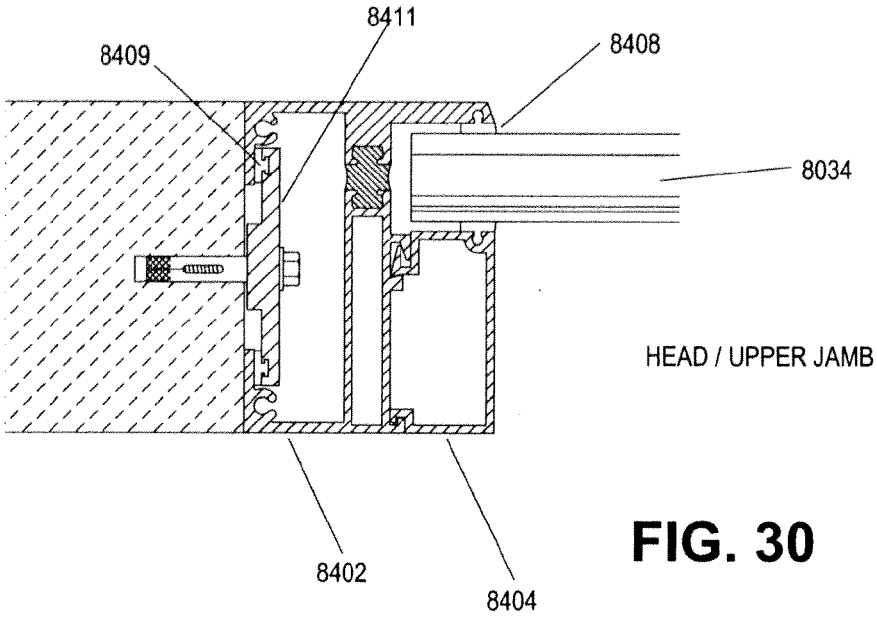
FIG. 30 is a view of a head/upper jamb of the window of FIG. 28.
Figure 31:
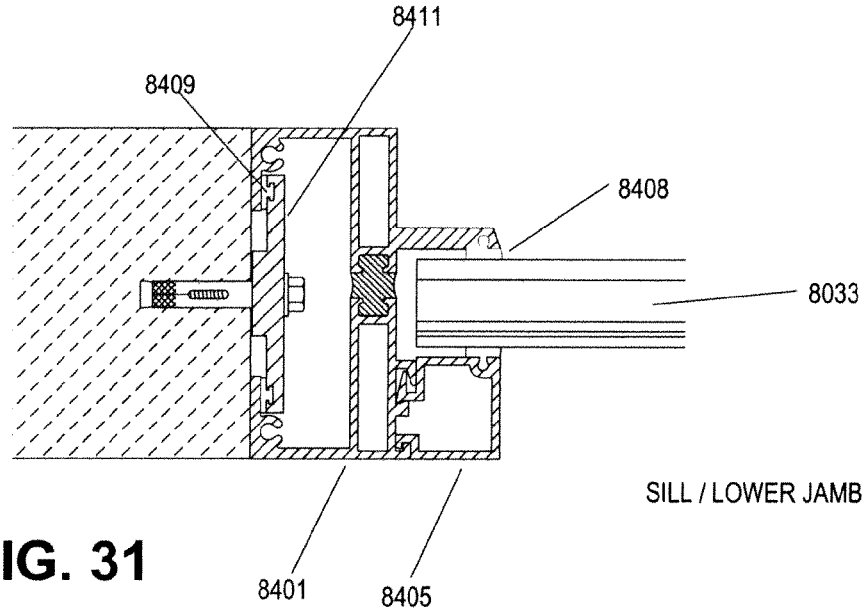
FIG. 31 is a view of a sill/lower jamb of the window of FIG. 28.

Referring now to FIG. 28, an elevation view of another embodiment of the invention is shown, as a single/double hung look, fixed window, having a specified blast resistance. This example is also a dual light window, with an upper half and a lower half separated by a horizontal mullion (whose cross-section is depicted in FIG. 29). The window has an upper glazing 8034 and a lower glazing 8033, permanently fixed with respect to each other by the mullion (FIG. 29). The upper glazing 8034 is framed, on its left and right sides and head, by head/upper jamb base pieces 8402 (see sectional view in FIG. 30). The lower glazing 8033, however, uses different, sill/lower jamb base pieces 8401, depicted in FIG. 31. In this embodiment, the lower jamb and sill have essentially the same cross-section, while the upper jamb and head also have essentially the same cross-section. To provide the offset look of a single/double hung window, the glazing channel for the upper glazing 8034 is offset, in a depth direction, with respect to that of the lower glazing 8033. This offset is achieved in this case by extruding the head/upper jamb base piece 8402 differently than the sill/lower jamb base piece 8401, by positioning the glazing channel and thermal break laterally, in the depth direction, as shown in FIGS. 30-31. To maintain a flat aesthetic profile on the safe side, the glazing stop piece 8405 is shorter, in depth, than the glazing stop piece 8404. The mechanism for securing the glazing in place, using the stop piece 8404 or 8405, is essentially the same as the one described above for the sill condition shown in FIG. 10.

Figure 35:
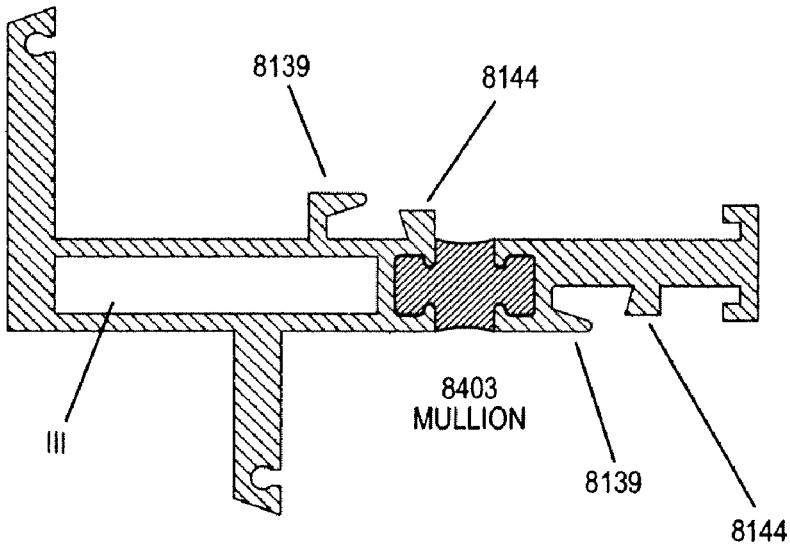
FIG. 35 is a view of a mullion piece for the window of FIG. 28.
Figure 36A:
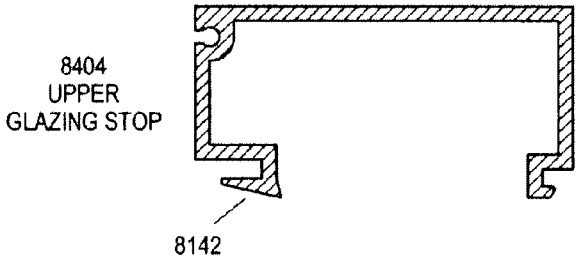
FIGS. 36A and 36B are close up views of glazing stop pieces for the embodiment of FIG. 28.
Figure 36B:
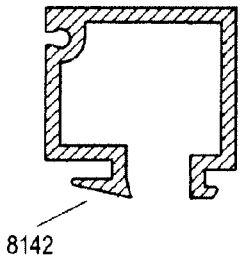

Note, however, that the horizontal mullion base piece 8403 (FIG. 29) differs, in its cross-section, from the horizontal muntin base piece 8106 depicted in FIG. 9, in that there is no cavity 8173 in front of the glazing channel. This provides additional strength, at the expense of additional weight. In addition, the rear portion of the mullion base 8403 differs from the rear portion of the sill base piece 8102 (FIG. 10) in that the cavity III does not extend all the way back to the rear wall, but rather stops at the glazing channel, beyond which the mullion base piece 8403 may continue as a solid piece all the way to the rear. In the embodiment of FIG. 29, a thermal break 8184 is located between the cavity III and the rear face of the mullion base piece 8404. Referring now to close up views of FIGS. 35, 36A and 36B, the thermal break 8184 may be situated such that first retaining portions 8139 extend out from the top and bottom faces of the mullion base piece 8403 on either side of the thermal break. Recall that as in FIG. 12, the first retaining portion 8139 forms a pocket whose opening in both cases faces the rear and is to receive therein a finger 8142 of upper and lower glazing stop pieces 8404, 8405 (see close up views in FIGS. 35 and 36A and 36B).

Figure 13:
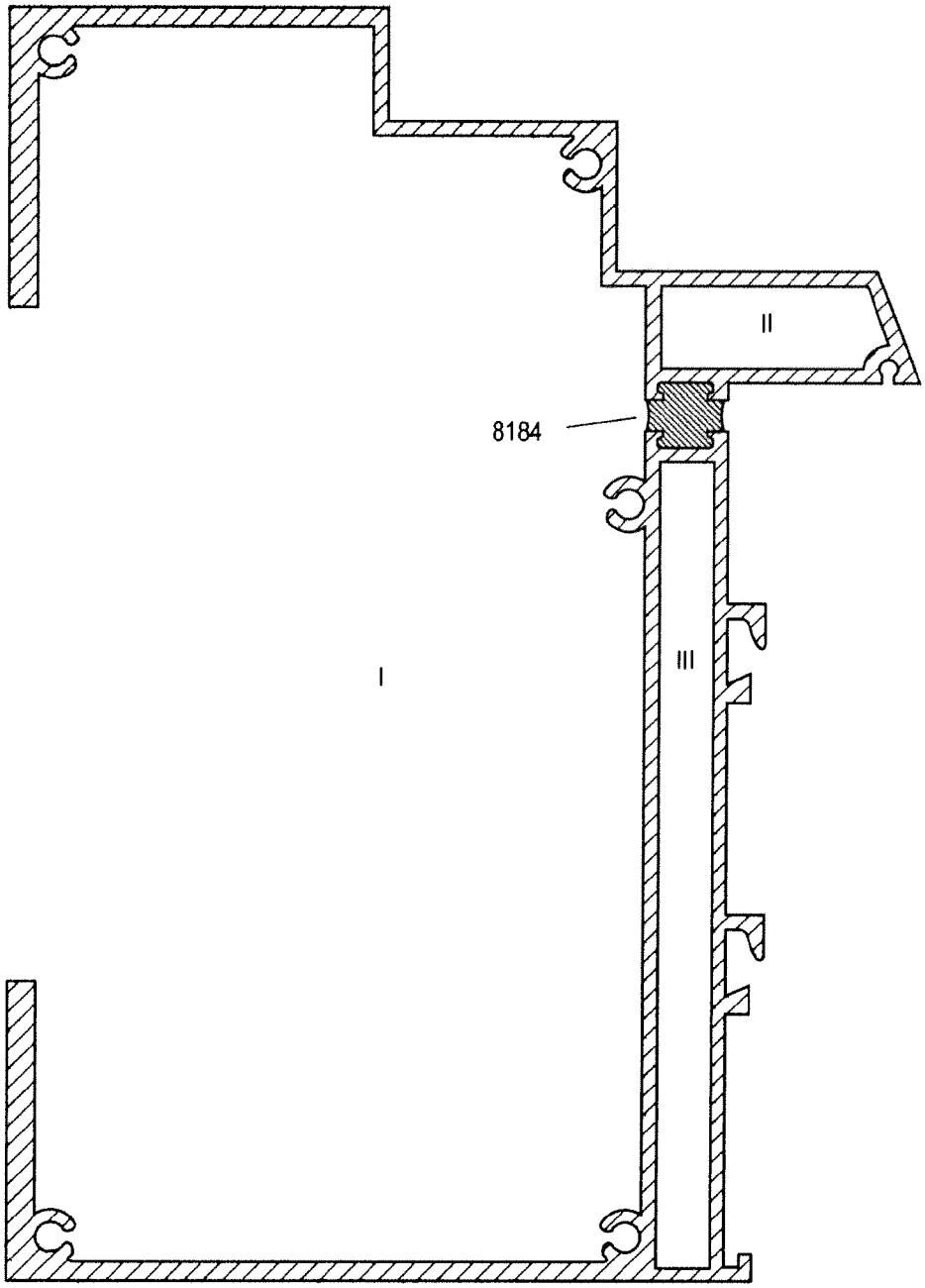
FIG. 13 is a close up view of another version of the head/jamb base piece of FIG. 12, with a thermal break.
Figure 38:
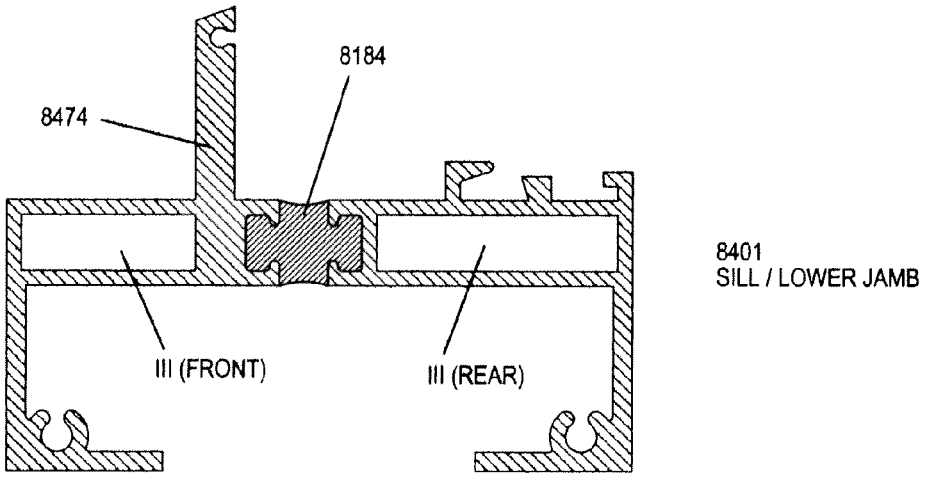
FIG. 38 is a view of a sill/lower jamb piece for the window of FIG. 28.
Figure 37:
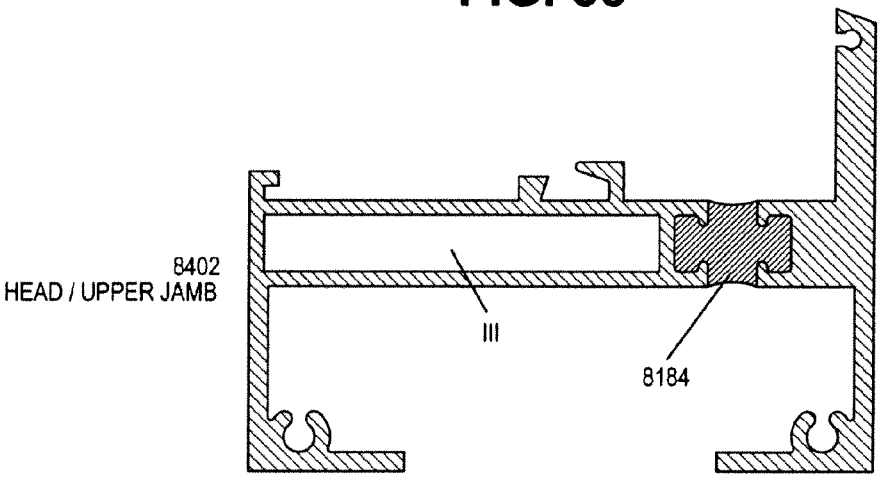
FIG. 37 is a view of a head/upper jam piece for the window of FIG. 28.

The head/upper jamb and sill/lower jamb sections of the embodiment of FIG. 28 are reinforced relative to the head/jamb base piece 8101 in FIG. 13, by thicker walls. Compare the cross-section of the head/upper jamb base piece 8402, shown in FIG. 30, with that of the thermally broken head/jamb piece 8101 in FIG. 13. A close up view of the head/upper jamb base piece 8402 is shown in FIG. 37, where the cavity III runs all the way to the rear wall (same as in FIG. 13) but the cavity II has been essentially filled (directly in front of the glazing channel). Also, note how in this version of a single/double hung look, fixed window, the offset or stepped back look for the lower glazing 8033 is achieved in a different manner than the window of FIG. 6. The stepped back look is achieved by positioning the portion 8474 of the front wall rearward as shown in FIG. 38. Note that in this particular embodiment, a thermal break 8184 is formed, splitting cavity III into two portions, a front portion and a rear portion, as shown. Each of these portions is laterally closed and may be sleeved for reinforcement using, for example, an angled shear block (at a corner) and/or a straight shear block that may run the full length of the piece.

Figure 33:
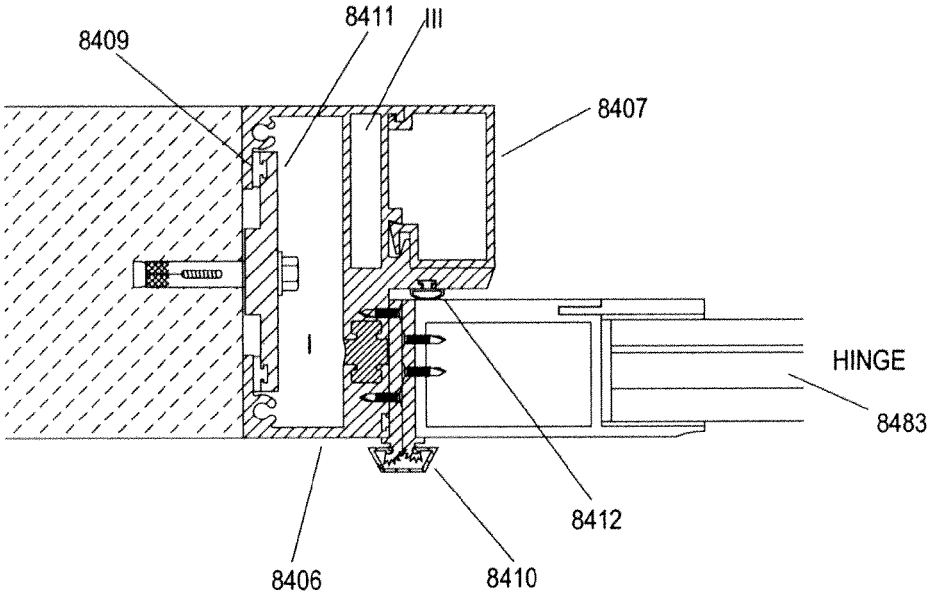
FIG. 33 is a view of a hinge section of the window of FIG. 32.
Figure 34:
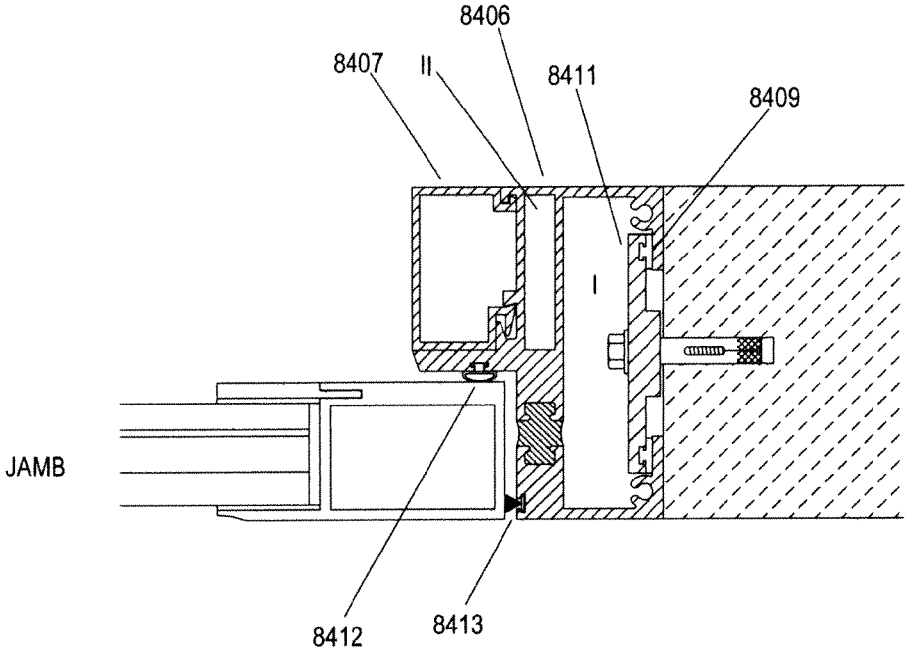
FIG. 34 is a view of a jamb section of the window of FIG. 32.
Figure 39A:
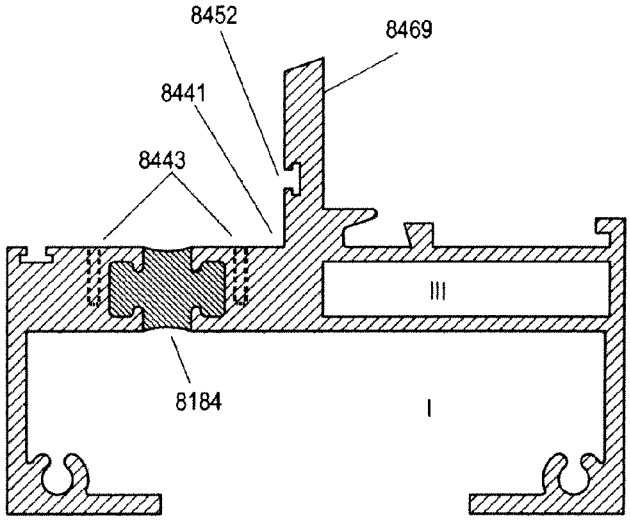
FIGS. 39A and 39B are views of a door base piece and a hinge for the window of FIG. 32.

Turning now to FIG. 32, an elevation view of a blast resistant, casement window is shown. Sectional views of the hinge and jamb sections are in FIGS. 33 and 34, respectively. The window in this example swings open towards the threat side via a continuous, gear hinge 8410 (FIG. 33). A stationary leaf 8447 of the gear hinge 8410 is secured to a right facing side of an operable door base piece 8406, using a number of fasteners. In this embodiment, a thermal break 8184 is formed beside, as opposed to in front of or behind, a cavity I, and is positioned such that fastener holes 8443 are on either side of it (see FIGS. 39A, 39B and 39C for close up views). The thermal break 8184 is positioned, in this embodiment, entirely in front of a cavity III that extends all the way to a rear wall of the door base 8406. Once again, the cavity III may be sleeved for reinforcement, either by an angle block at a corner, and/or by a straight shear block that may run the full length of the door base piece 8406. See also the sectional view of the jamb, shown in FIG. 34, which uses an identical base piece 8406, base plate 8411, and aesthetic cover 8407.

Figure 39B:
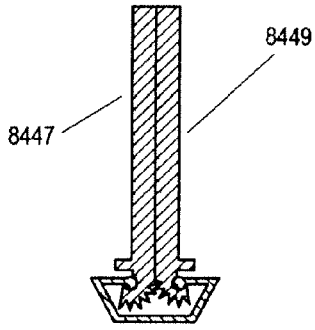

As seen in the close up views of FIGS. 38A and 39B, the operable door base piece 8406 uses the region 8441 to receive therein the continuous gear hinge 8410 to which is attached a framed glazing 8483 (see FIG. 33). The frame for the glazing 8483 may be in accordance with the techniques described in U.S. patent application Ser. No. 11/051,612 entitled "Window Framing System for Sliding Windows", filed Feb. 3, 2005, and in U.S. patent application Ser. No. 10/241,906, entitled "Explosion Resistant Window System". The glazing frame is secured to the second leaf 8449 of the gear hinge 8410, using, for example, a number of fasteners that are passed through the leaf 8449 and into a left facing side of the glazing frame as shown in FIG. 33. When the window is in its closed position as depicted in FIG. 33, the glazing frame rests against a bulb vinyl piece 8412 that has been installed into its reglet 8452. This reglet is formed in a front facing surface of the support wall 8471 that may be perpendicular to and extends inward from the surface of a side 8469. The reglet may run the full length of the piece. Note that the pivot axis of the hinge (which runs parallel to a longitudinal axis of the base piece 8406) is positioned in front of the leaves 8447, 8449, so that the window can open into the threat side.

The base piece 8406 is anchored to the building support structure by, in this embodiment, an anchor plate 8411 that is positioned inside the cavity I. A pair of dense, EPDM seals 8409 are installed in their respective reglets that may run the full length of the anchor plate piece 8411, where the reglets are positioned on opposite sides of a center island, formed in the building support structure facing side of the anchor plate. The plate is sized and positioned (when installed) such that its island is located at least in part within the opening in the outward facing surface of the side wall 8469 (see FIG. 39A). Fasteners, such as concrete anchor bolts, are passed through holes in the island and into the building support structure. This anchoring mechanism is essentially the same as, for example, the head/upper jamb section of FIG. 7 and the sill section of FIG. 10, except that the anchor plate 8411 is thicker particularly at its end portions, where the reglets are formed and where there is contact with an inside surface of the side wall 8463 (for additional reinforcement). An aesthetic cover piece 8407 can be snapped fitted into place in the same manner as the glazing stop pieces described above (e.g., lower glazing stop piece 8405, upper glazing stop piece 8404, see FIG. 36A). Note that in this jamb section, the side 8467 of the framed glazing (FIG. 34) rests against a weather strip 8413 which has been installed in a reglet. The reglet is formed in a surface of the side 8469 that faces inward, and is located in front of the thermal break 8184 (see FIG. 39A).

The invention is not limited to the specific embodiments described above. For example, changes to the aesthetic profile on the safe and threat sides shown here may be made. Also, the glazing thicknesses may vary. Accordingly, other embodiments are within the scope of the claims.

What is claimed is:

1. A frame for a window, comprising:

first and second frame sections to join each other at a corner of a glazing for the window, each section having a base piece and a glazing stop piece, the base piece to be anchored to a support structure of a building, the base piece having a first cavity with a front wall and rear wall, a second cavity sharing a wall with the first cavity and having all of its walls made of the same material, and a third cavity sharing a wall with the second cavity and another wall with the first cavity and located to the rear of the second cavity, wherein a glazing channel lies beside as opposed to behind or in front of the third cavity and faces the safe side of the window and is to receive therein the glazing, and the glazing stop piece to be secured to the base piece and thereby hold the glazing in its channel, and in the base piece of the first frame section, the first cavity has a lateral opening into the support structure of a building that runs the entire length of the base piece, and an anchor plate by which the base piece of the first frame section is to be anchored to the support structure of a building through the lateral opening in the base piece, the anchor plate having a middle section positioned over the lateral opening and end sections overlapping ends of the base piece forming the lateral opening.

2. The frame of claim 1 wherein the third cavity is entirely screened off by the second cavity.

3. The frame of claim 1 wherein the second cavity is located behind the front wall, and wherein intersecting walls of the second and third cavities define the glazing channel.

4. The frame of claim 1 wherein the base piece has a thermal break formed between the second and third cavities.

5. The frame of claim 1 further comprising a shear block to be fitted inside the second cavity.

6. The frame of claim 1 further comprising a shear block to be fitted inside the third cavity.

7. The frame of claim 1 wherein in the base piece of the first frame section, the second cavity has a lateral opening into the glazing channel and that runs the entire length of the base piece.

8. The frame of claim 7 wherein the second cavity has a front wall with a hole to allow draining.

9. The frame of claim 8 further comprising a thermally insulative material sandwiched between the base piece and end sections of the anchor plate to achieve a thermal break.

* * * * *